US009453707B2

(12) United States Patent
Williams et al.

(10) Patent No.: US 9,453,707 B2
(45) Date of Patent: Sep. 27, 2016

(54) SYSTEMS AND METHODS FOR A SCOPE MOUNT ASSEMBLY

(71) Applicant: Keng's Firearms Specialty, Inc., Atlanta, GA (US)

(72) Inventors: Alvin Williams, Smyrna, GA (US); Kio James, Austell, GA (US); David Bonelli, Smyrna, GA (US); William Brown, Marietta, GA (US); Aaron L. Hampton, Columbus, GA (US)

( * ) Notice: Subject to any disclaimer, the term of this patent is extended or adjusted under 35 U.S.C. 154(b) by 0 days.

(21) Appl. No.: 14/940,311

(22) Filed: Nov. 13, 2015

(65) Prior Publication Data

US 2016/0069642 A1 Mar. 10, 2016

Related U.S. Application Data

(62) Division of application No. 14/209,654, filed on Mar. 13, 2014, now abandoned.

(60) Provisional application No. 61/788,431, filed on Mar. 15, 2013, provisional application No. 61/818,183, filed on May 1, 2013.

(51) Int. Cl.
*F41G 1/387* (2006.01)
*F41G 11/00* (2006.01)

(52) U.S. Cl.
CPC ..... *F41G 1/387* (2013.01); *F41G 11/003* (2013.01)

(58) Field of Classification Search
CPC ..... F41G 1/38; F41G 1/387; F41G 1/16; F41G 1/28; F41G 11/001; F41G 11/003–11/008
USPC ..... 42/124–128, 90
See application file for complete search history.

(56) References Cited

U.S. PATENT DOCUMENTS

| | | | |
|---|---|---|---|
| 5,155,915 | A | 10/1992 | Repa |
| 6,442,883 | B1 | 9/2002 | Waterman et al. |
| 6,629,381 | B1 | 10/2003 | Keng |
| 6,922,934 | B1 | 8/2005 | Huan |
| 6,931,778 | B1 | 8/2005 | Nelson et al. |
| 7,107,716 | B1 | 9/2006 | Liao |
| 7,543,405 | B1 | 6/2009 | Ivey |
| 7,562,485 | B2 | 7/2009 | Newhall et al. |
| 8,132,355 | B1 | 3/2012 | Kincaid et al. |
| 8,215,046 | B2 | 7/2012 | Chvala |
| 8,397,421 | B2 | 3/2013 | Ding et al. |

(Continued)

FOREIGN PATENT DOCUMENTS

WO 2011031204 A1 3/2011

OTHER PUBLICATIONS

International Search Report and Written Opinion for International Application No. PCT/US2014/025645 mailed Jul. 24, 2014.

*Primary Examiner* — Jonathan C Weber
(74) *Attorney, Agent, or Firm* — Sutherland Asbill & Brennan LLP

(57) ABSTRACT

A scope mount assembly for removeably attaching a scope to a firearm is disclosed herein. The firearm may include a rail assembly. The scope mount assembly may include a base member and at least one ring extending from the base member. The at least one ring may be configured to secure at least a portion of the scope therein. Moreover, the scope mount assembly may include at least one scope mount rail assembly extending from the ring.

13 Claims, 25 Drawing Sheets

(56) References Cited

U.S. PATENT DOCUMENTS

| | | | |
|---|---|---|---|
| 8,424,234 | B2 | 4/2013 | Carlson et al. |
| 8,438,965 | B2 | 5/2013 | Collin et al. |
| 8,490,313 | B2 | 7/2013 | Frascati et al. |
| 8,490,316 | B2 | 7/2013 | Kincel et al. |
| 8,505,228 | B2 | 8/2013 | Cheng |
| 8,667,727 | B2 | 3/2014 | Engelhardt |
| 8,733,011 | B2 | 5/2014 | Spuhr |
| 8,769,859 | B2 | 7/2014 | Li et al. |
| 8,800,194 | B2 | 8/2014 | Teetzel et al. |
| 2006/0117636 | A1 | 6/2006 | Newhall et al. |
| 2009/0307956 | A1 | 12/2009 | Barret |
| 2010/0154280 | A1 | 6/2010 | LaFrance et al. |
| 2011/0047855 | A1 | 3/2011 | Wong |
| 2011/0067287 | A1 | 3/2011 | Collin et al. |
| 2012/0017482 | A1 | 1/2012 | Chvala |
| 2012/0167438 | A1 | 7/2012 | Daniel et al. |
| 2012/0174462 | A1 | 7/2012 | Spuhr |
| 2012/0180363 | A1 | 7/2012 | Frascati et al. |
| 2012/0311909 | A1 | 12/2012 | Cheng |
| 2013/0318852 | A1 | 12/2013 | Teetzel et al. |
| 2014/0190062 | A1 | 7/2014 | Turner, Jr. et al. |

SYSTEMS AND METHODS FOR A SCOPE MOUNT ASSEMBLY

CROSS-REFERENCE TO RELATED APPLICATIONS

The disclosure is a divisional of U.S. application Ser. No. 14/209,654, filed Mar. 13, 2014, which claims priority to and the benefit of U.S. provisional application No. 61/788,431, filed Mar. 15, 2013, and U.S. provisional application No. 61/818,183, filed May 1, 2013, which are both herein incorporated by reference in their entirety.

FIELD OF THE DISCLOSURE

The disclosure generally relates to a firearm and more particularly relates to systems and methods for a scope mount assembly.

BACKGROUND

Firearms typically include a rail assembly, such as a picatinny rail, for the attachment of accessories. One such accessory is a scope. Scopes provide a user with a magnified field of view that facilitates more accurate shot placement. Typically, scope mount assemblies are used to attach the scope to the firearm. Many scope mount assemblies, however, utilize a substantial amount of the rail assembly of the firearm and/or the scope may interfere with the use of certain portions of the rail assembly of the firearm.

SUMMARY

Some or all of the above needs and/or problems may be addressed by certain embodiments of the scope mount assembly for removeably attaching a scope to a firearm disclosed herein. According to an embodiment, the firearm may include a rail assembly. The scope mount assembly may include a base member and at least one ring extending from the base member. The at least one ring may be configured to secure at least a portion of the scope therein. Moreover, the scope mount assembly may include at least one scope mount rail assembly extending from the ring.

Other features and aspects of the scope mount assembly will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
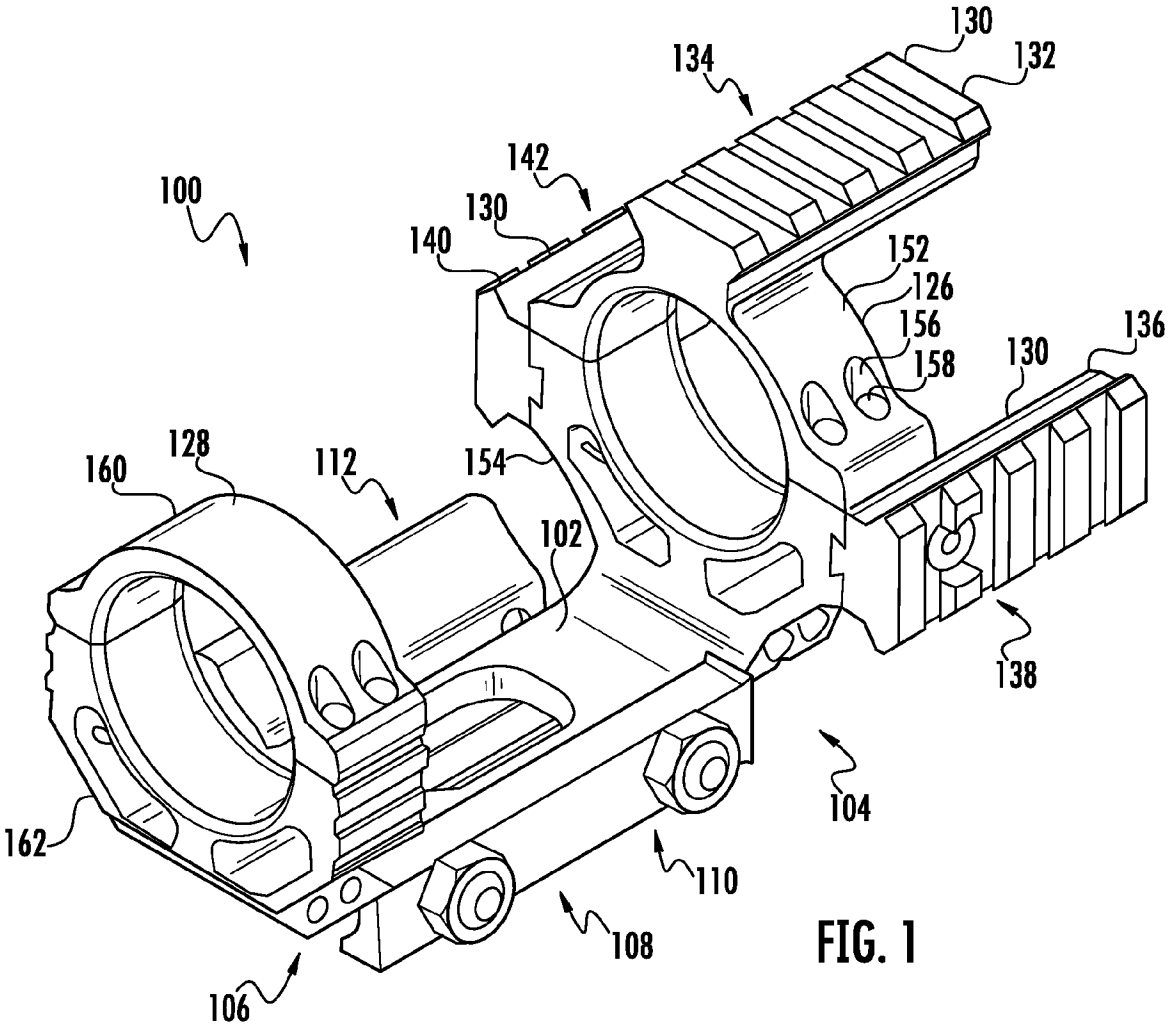
FIG. 1 schematically depicts a perspective view of a scope mount assembly in accordance with one or more embodiments of the disclosure.
Figure 2:
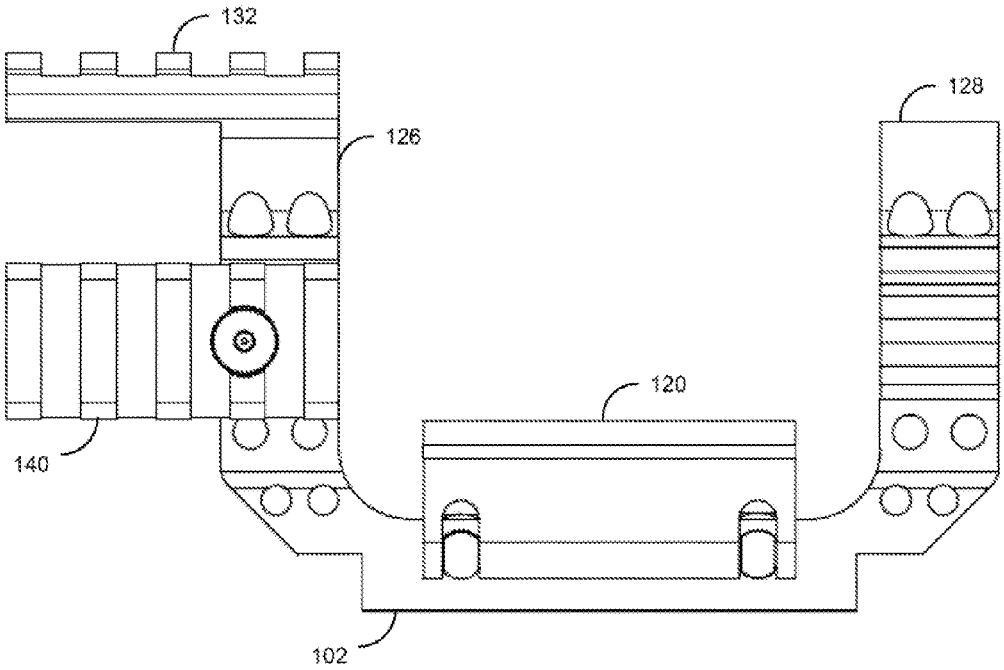
FIG. 2 schematically depicts a side view of a scope mount assembly in accordance with one or more embodiments of the disclosure.

Described below are embodiments of a scope mount assembly (as well as individual components of the scope mount assembly) that can be removeably attached to a firearm. Methods of installing and using the scope mount assembly on the firearm are also disclosed. The firearm may be a conventional firearm. For example, the firearm may be an M-16 style rifle, an AR-15 style rifle, an AR-10 style rifle, an M-4 style rifle, a hunting rifle, or a shotgun, among others. The firearm may include a rail assembly, such as a picatinny rail or the like. The scope mount assembly may be configured to provide a scope mount rail assembly. Moreover, the scope mount assembly may be configured to prevent unintentional and/or unwanted detachment of the scope mount assembly from the firearm.

According to an embodiment, the scope mount assembly may include a base member and at least one ring extending from the base member. The at least one ring may be configured to secure at least a portion of the scope therein. Moreover, the scope mount assembly may include at least one scope mount rail assembly extending from the ring.

In certain embodiments, the base member may include a front portion and a rear portion. Moreover, the base member may include an attachment mechanism configured to removeably attach the base member to the rail assembly of the firearm. For example, the attachment mechanism may comprise a clamp assembly and a lever assembly. The clamp assembly may include a clamped position and an unclamped position, and the lever assembly may be operable to move the clamp assembly between the clamped position and the unclamped position. For example, the clamp assembly and the lever assembly may be in mechanical communication by way of a cam-type mechanism or the like. In this manner, the lever assembly may move the clamp assembly between the clamped position and the unclamped position as the lever assembly moves between a locked position and an unlocked position, respectively.

In some instances, the clamp assembly may include a fixed clamp and a moveable clamp. The fixed clamp may be associated with the base member. That is, the fixed clamp may be affixed to the base member. The moveable clamp may be operable to move relative to the fixed clamp between the clamped position and the unclamped position. In other instances, the lever assembly may include a lever disposed on an opposite side of the base member from the moveable clamp. In certain embodiments, at least one coupling rod may couple the lever and the moveable clamp. In this manner, movement of the lever may move the moveable clamp. For example, the lever may be operable to be manipulated by a user. In some aspects, a clamping force of the clamp assembly may be adjusted by increasing or decreasing a distance between the fixed clamp and the moveable clamp along the at least one coupling rod. In other aspects, the at least one coupling rod may be configured to at least partially protrude between at least two mounting projections on the rail assembly of the firearm when attached thereto. In certain embodiments, a silhouette of the clamp assembly may correspond to a profile of the rail assembly of the firearm.

According to an embodiment, the lever may be sized and shaped to nest adjacent to the scope when in the locked position. In this manner, the lever may be configured to prevent the user from unintentionally moving the lever to the unlocked position. For example, the lever may be manipulated down and away from the scope to the unlocked position. Conversely, the lever may be manipulated upward towards the scope to the locked position.

In certain embodiments, the scope mount assembly may include a front ring and/or a rear ring. The front ring may extend from the front portion of the base member, and the rear ring may extend from the rear portion of the base member. The front ring and the rear ring may be configured to individually and/or collectively secure at least a portion of the scope therein. In some instances, the scope mount assembly may include only a single ring.

The scope mount assembly may include at least one scope mount rail assembly extending from the front ring and/or the rear ring. In some instances, the at least one scope mount rail assembly may comprise a top rail assembly (affixed or removable) extending from a top portion of the front ring and/or the rear ring. In other instances, the at least one scope mount rail assembly may comprise a removable first side rail assembly extending from a first side of the front ring and/or the rear ring. In yet other instances, the at least one scope mount rail assembly may comprise a removable second side rail assembly extending from a second side of the front ring and/or the rear ring.

In certain embodiments, the removable first side rail assembly and/or the removable second side rail assembly may comprise a dovetail. Moreover, the first side of the front ring and/or the rear ring and/or the second side of the front ring and/or the rear ring may include a corresponding dovetail channel. That is, in one example, the first side of the front ring may include a corresponding dovetail channel to the dovetail of the first side rail assembly, and the second side of the front ring may include a corresponding dovetail channel to the dovetail of the second side rail assembly. In certain embodiments, the front ring and/or the rear ring may include one or more attachment/positioning devices for attaching and/or positioning the scope mount rail assembly thereon. Further, the scope mount rail assembly may include an attachment adapter that corresponds to the attachment/positioning devices. Other attachment configurations may be used to attach the rail assemblies to the scope mount assembly.

In some instances, the front ring may comprise a top half and a bottom half. In this manner, the top half and the bottom half of the front ring may be configured to be fastened together and/or disassembled. Similarly, the rear ring may comprise a top half and a bottom half. In this manner, the top half and the bottom half of the rear ring may be configured to be fastened together and/or disassembled. This configuration may facilitate the installation of the scope to the scope mount assembly.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Illustrative Embodiments

FIGS. 1-6 schematically depict a scope mount assembly 100 (as well as individual components of the scope mount assembly 100) that can be attached to a firearm in accordance with one or more embodiments of the disclosure. The firearm may be a conventional and/or a tactical firearm. By way of example, the firearm may be any number of firearms, such as, but not limited to, an M-16 style rifle, an AR-15 style rifle, an AR-10 style rifle, or an M-4 style rifle, a hunting rifle, a shotgun, or the like. Moreover, the firearm may be a handgun or the like. The firearm may include a rail assembly, such as a picatinny rail or the like.

Figure 3:
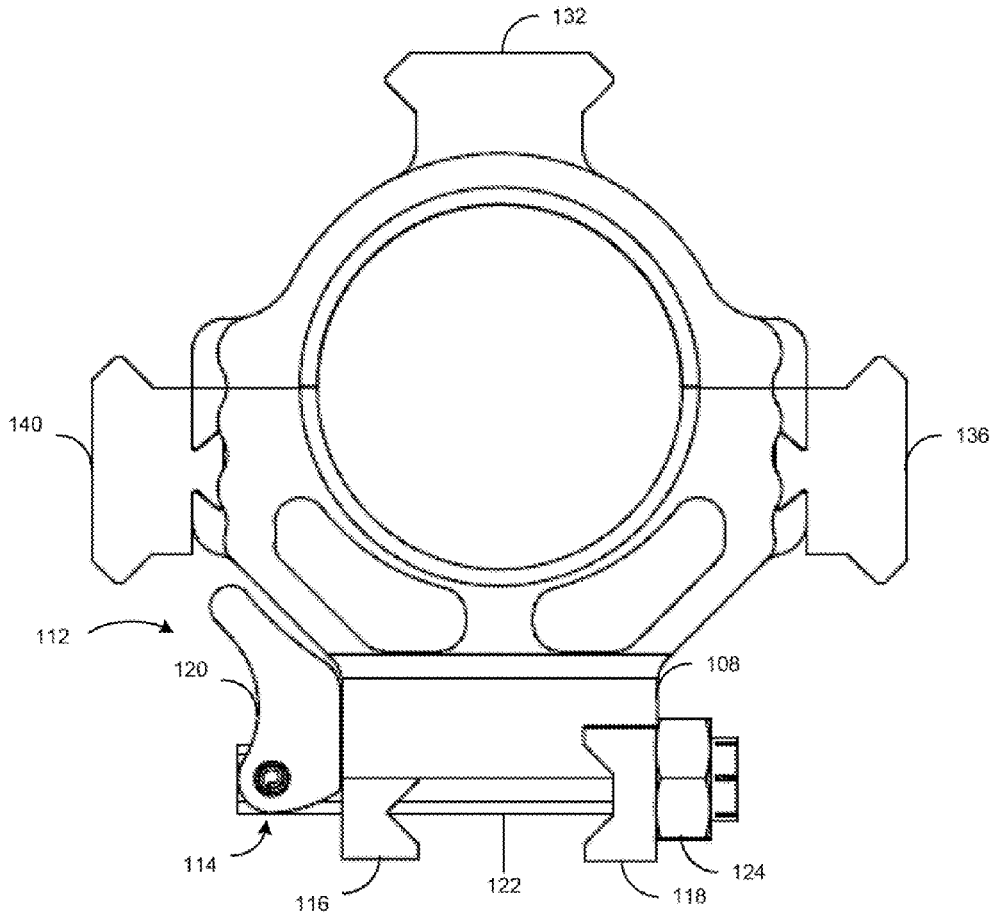
FIG. 3 schematically depicts a front view of a scope mount assembly in accordance with one or more embodiments of the disclosure.
Figure 4:
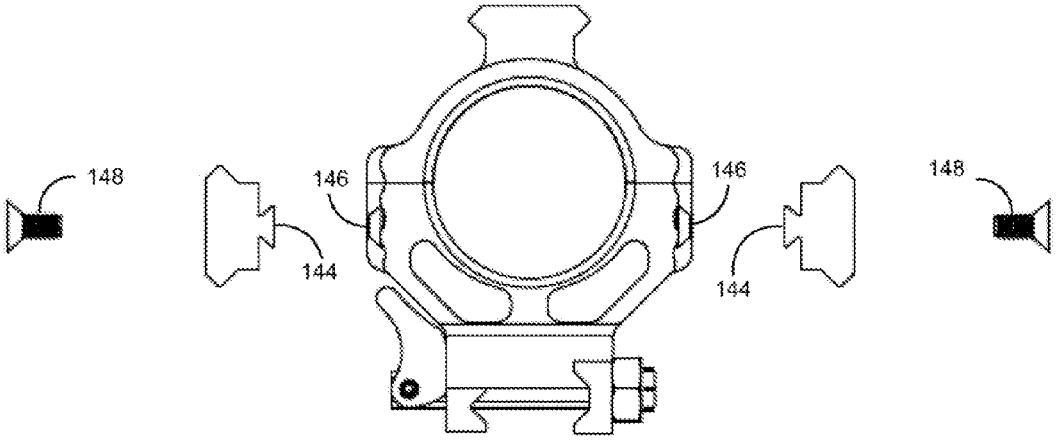
FIG. 4 schematically depicts a partially exploded front view of a scope mount assembly in accordance with one or more embodiments of the disclosure.
Figure 5:
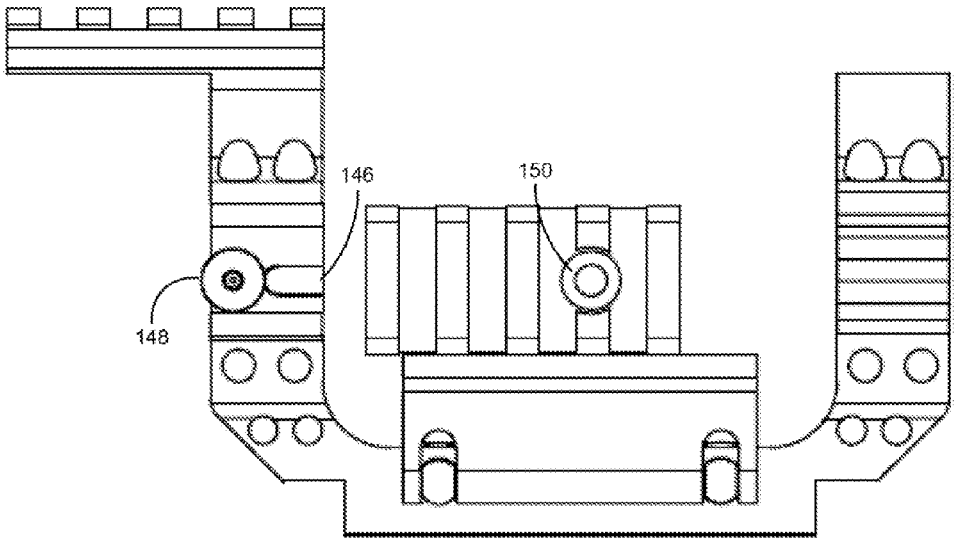
FIG. 5 schematically depicts a partially exploded side view of a scope mount assembly in accordance with one or more embodiments of the disclosure.
Figure 6:
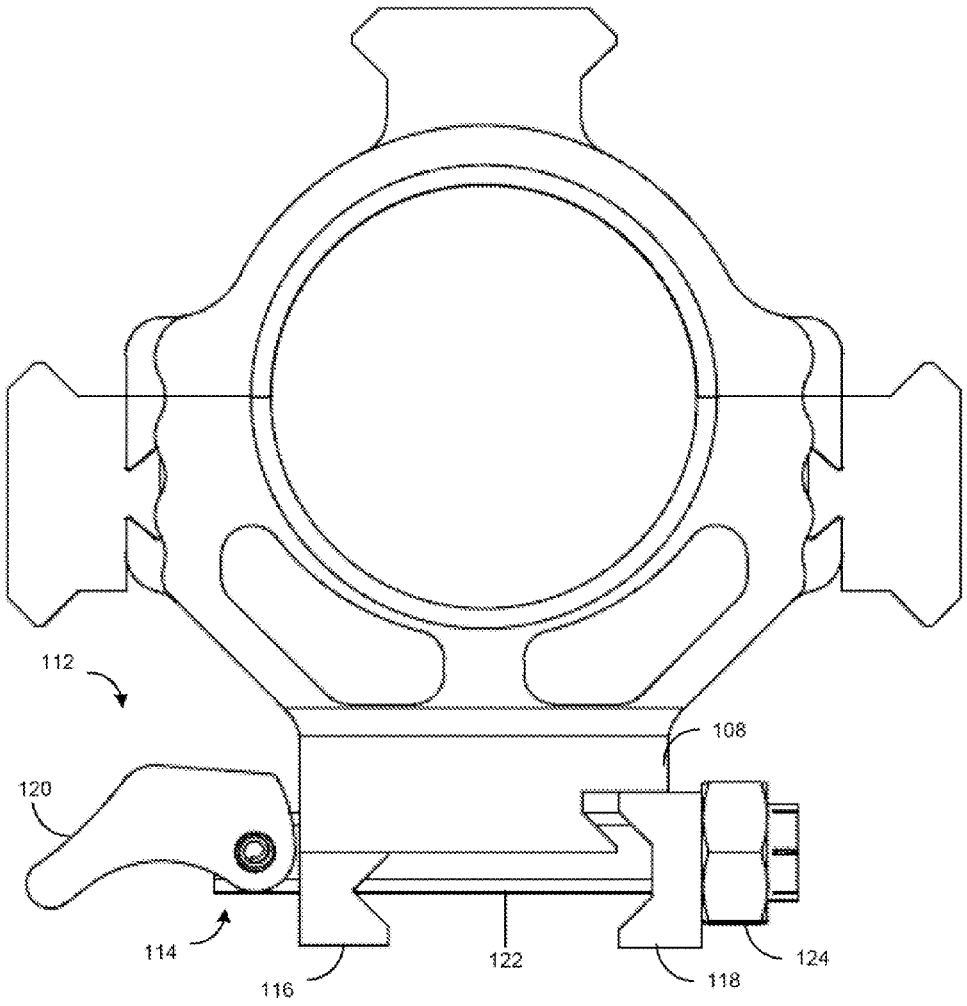
FIG. 6 schematically depicts a front view of a scope mount assembly in accordance with one or more embodiments of the disclosure.

In certain embodiments, the scope mount assembly 100 may include a base member 102. The base member 102 may include a front portion 104 and a rear portion 106. In some instances, the base member 102 may be generally rectangular in shape. Moreover, the base member 102 may include an attachment mechanism 108. The attachment mechanism 108 may be configured to removeably attach the base member 102 to the rail assembly of the firearm. That is, in some instances, the attachment mechanism 108 may be configured to be attached to a picatinny rail or the like. For example, the attachment mechanism 108 may comprise a clamp assembly 110 and a lever assembly 112. The clamp assembly 110 may include a clamped position (as depicted in FIG. 3) and an unclamped position (as depicted in FIG. 6). The lever assembly 112 may be operable to move the clamp assembly 110 between the clamped position and the unclamped position. For example, the clamp assembly 110 and the lever assembly 112 may be in mechanical communication by way of a cam-type mechanism 114 or the like. In this manner, the lever assembly 112 may move the clamp assembly 110 between the clamped position and the unclamped position as the lever assembly 112 moves between a locked position (as depicted in FIG. 3) and an unlocked position (as depicted in FIG. 6), respectively.

In some instances, the clamp assembly 110 may include a fixed clamp 116 and a moveable clamp 118. The fixed clamp 116 may be associated with the base member 108. That is, the fixed clamp 116 may be affixed to the base member 108. The fixed clamp 116 and the base member 108 may be separate components or integral. The moveable clamp 118 may be operable to move relative to the fixed clamp 116 between the clamped position and the unclamped position. In other instances, the lever assembly 112 may include a lever 120 disposed on an opposite side of the base member 102 from the moveable clamp 118. In certain embodiments, at least one coupling rod 122 may couple the lever 120 and the moveable clamp 118. In this manner, movement of the lever 120 may move the moveable clamp 118. For example, the lever 120 may be operable to be manipulated by a user. That is, the user may move the lever 120 up and down. In this manner, movement of the lever 120 by the user may move the clamp assembly 110 between the clamped position and the unclamped position.

In some aspects, a clamping force of the clamp assembly 110 may be adjusted by increasing or decreasing a distance between the fixed clamp 116 and the moveable clamp 118 along the at least one coupling rod 122. For example, one or more lugs 124 may be tightened or loosened to increase or decrease a clamping force of the clamping assembly 110. In other aspects, the at least one coupling rod 122 may be configured to at least partially protrude between at least two mounting projections on the rail assembly of the firearm when attached thereto. In this manner, the at least one coupling rod 122 may prevent the base member 102 from sliding along the rail assembly of the firearm when attached thereto. In certain embodiments, a silhouette of the clamp assembly 110 may correspond to a profile of the rail assembly of the firearm. That is, the silhouette of the clamp assembly 110 may be configured to mate with the profile of the rail assembly of the firearm.

According to an embodiment, the lever 120 may be sized and shaped to nest adjacent to the scope when in the locked position. In this manner, the lever 120 may be configured to prevent the user from unintentionally moving the lever 120 to the unlocked position. For example, the lever 120 may be manipulated down and away from the scope to the unlocked position. Conversely, the lever 120 may be manipulated upward towards the scope to the locked position. When in the locked position, at least a portion of the lever 120 may nest adjacent to the scope secured within the scope mount assembly 100.

In certain embodiments, the scope mount assembly 100 may include a front ring 126 and a rear ring 128. The front ring 126 may extend from the front portion 104 of the base member 102, and the rear ring 128 may extend from the rear portion 106 of the base member 102. The front ring 126 and the rear ring 128 may be configured to individually and/or collectively secure at least a portion of the scope therein. In some instances, the base member 102, the front ring 126, and/or the rear ring 128 may be separate components. In other instances, the base member 102, the front ring 126, and/or the rear ring 128 (or portions thereof) may be a single machined piece of metal or the like.

The scope mount assembly 100 may include at least one scope mount rail assembly 130 extending from the front ring 126. The scope mount rail 130 may extend from the front ring 126 in an orientation that is generally away from the rear ring 128. That is, the scope mount rail 130 may extend towards a muzzle end of the firearm when attached thereto. In some instances, the at least one scope mount rail assembly 130 may comprise a top rail assembly 132 extending from a top portion 134 (e.g., a 12:00 o'clock position) of the front ring 126. In some aspects, the top rail assembly 132 may be permanently attached to the top portion 134 of the front ring 126. That is, the top rail assembly 132 and the top portion 134 of the front ring 126 may be a single integral piece. In other instances, the at least one scope mount rail assembly 130 may comprise a removable first side rail assembly 136 extending from a first side 138 (e.g., a 3:00/6:00 o'clock position) of the front ring 126. Similarly, the at least one scope mount rail assembly 130 may comprise a removable second side rail assembly 140 extending from a second side 142 (e.g., a 3:00/6:00 o'clock position) of the front ring 126. The at least one scope mount rail assembly 130 may comprise a picatinny rail or the like.

In certain embodiments, the removable first side rail assembly 136 and/or the removable second side rail assembly 140 may comprise a dovetail 144. Moreover, the first side 138 of the front ring 126 and/or the second side 142 of the front ring 126 may include a corresponding dovetail channel 146. That is, the first side 138 of the front ring 126 may include a corresponding dovetail channel 146 to the dovetail 144 of the first side rail assembly 136, and the second side 142 of the front ring 126 may include a corresponding dovetail channel 146 to the dovetail 144 of the second side rail assembly 140. In certain aspects, the dovetail 144 of the removable first side rail assembly 136 may be slid into the dovetail channel 146 of the first side 138 of the front ring 126. Moreover, the removable first side rail assembly 136 may be secured to the first side 138 of the front ring 126 by way of a cap screw 148 or the like, although any securing mechanism may be used. For example, the removable first side rail assembly 136 and the first side 138 of the front ring 126 may include corresponding bores 150 configured to receive the cap screw 148 therein. Similarly, the dovetail 144 of the removable second side rail assembly 140 may be slid into the dovetail channel 146 of the second side 142 of the front ring 126. Moreover, the removable second side rail assembly 140 may be secured to the second side 142 of the front ring 126 by way of the cap screw 148 or the like, although any securing mechanism may be used. For example, the removable second side rail assembly 140 and the second side 142 of the front ring 126 may include corresponding bores 150 configured to receive the cap screw 148 therein.

In some instances, the front ring 126 may comprise a top half 152 and a bottom half 154. In this manner, the top half 152 and the bottom half 154 of the front ring 126 may be configured to be fastened together and/or disassembled. For example, the top half 152 and the bottom half 154 of the front ring 126 may include corresponding bores 156 that are configured to receive a cap screw 158 therein for securing the top half 152 and the bottom half 154 of the front ring 126 together. Similarly, the rear ring 128 may comprise a top half 160 and a bottom half 162. In this manner, the top half 160 and the bottom half 162 of the rear ring 128 may be configured to be fastened together and/or disassembled. For example, the top half 160 and the bottom half 162 of the rear ring 128 may include corresponding bores 156 that are configured to receive the cap screw 158 therein for securing the top half 160 and the bottom half 162 of the rear ring 128 together. The configuration of the front ring 126 and the rear ring 128 may facilitate the installation of the scope to the scope mount assembly 100. In some instances, the bottom half 154 of the front ring 126 and/or the bottom half 162 of the rear ring 128 may be a single machined piece of metal or the like.

FIGS. 8-22 schematically depict a scope mount assembly 200 (as well as individual components of the scope mount assembly 200) that can be attached to a firearm in accordance with one or more embodiments of the disclosure. In certain embodiments, the scope mount assembly 200 may include a base member 202. The base member 202 may include a front portion 204 and a rear portion 206. In some instances, the base member 202 may be generally rectangular in shape. Moreover, the base member 202 may include an attachment mechanism 208. The attachment mechanism 208 may be configured to removeably attach the base member 202 to the rail assembly of the firearm. That is, in some instances, the attachment mechanism 208 may be configured to be attached to a picatinny rail or the like. For example, the attachment mechanism 208 may comprise a clamp assembly 210 and a lever assembly 212. The clamp assembly 210 may include a clamped position and an unclamped position similar to those described with reference to FIGS. 1-6. The lever assembly 212 may be operable to move the clamp assembly 210 between the clamped position and the unclamped position. For example, the clamp assembly 210 and the lever assembly 212 may be in mechanical communication by way of a cam-type mechanism 214 or the like. In this manner, the lever assembly 212 may move the clamp assembly 210 between the clamped position and the unclamped position as the lever assembly 212 moves between a locked position and an unlocked position, respectively.

In some instances, the clamp assembly 210 may include a fixed clamp 216 and a moveable clamp 218. The fixed clamp 216 may be associated with the base member 208. That is, the fixed clamp 216 may be affixed to the base member 208. The fixed clamp 216 and the base member 208 may be separate components or integral. The moveable clamp 218 may be operable to move relative to the fixed clamp 216 between the clamped position and the unclamped position. In other instances, the lever assembly 212 may include a lever 220 disposed on an opposite side of the base member 202 from the moveable clamp 218. In certain embodiments, at least one coupling rod 222 may couple the lever 220 and the moveable clamp 218. In this manner, movement of the lever 220 may move the moveable clamp 218. For example, the lever 220 may be operable to be manipulated by a user. That is, the user may move the lever 220 up and down. In this manner, movement of the lever 220 by the user may move the clamp assembly 210 between the clamped position and the unclamped position.

In some aspects, a clamping force of the clamp assembly 210 may be adjusted by increasing or decreasing a distance between the fixed clamp 216 and the moveable clamp 218 along the at least one coupling rod 222. For example, one or more lugs 224 may be tightened or loosened to increase or decrease a clamping force of the clamping assembly 210. In other aspects, the at least one coupling rod 222 may be configured to at least partially protrude between at least two mounting projections on the rail assembly of the firearm when attached thereto. In this manner, the at least one coupling rod 222 may prevent the base member 202 from sliding along the rail assembly of the firearm when attached thereto. In certain embodiments, a silhouette of the clamp assembly 210 may correspond to a profile of the rail assembly of the firearm. That is, the silhouette of the clamp assembly 210 may be configured to mate with the profile of the rail assembly of the firearm.

According to an embodiment, the lever 220 may be sized and shaped to nest adjacent to the scope when in the locked position. In this manner, the lever 220 may be configured to prevent the user from unintentionally moving the lever 220 to the unlocked position. For example, the lever 220 may be manipulated down and away from the scope to the unlocked position. Conversely, the lever 220 may be manipulated upward towards the scope to the locked position. When in the locked position, at least a portion of the lever 220 may nest adjacent to the scope secured within the scope mount assembly 200.

In certain embodiments, the scope mount assembly 200 may include a front ring 226 and a rear ring 228. The front ring 226 may extend from the front portion 204 of the base member 202, and the rear ring 228 may extend from the rear portion 206 of the base member 202. The front ring 226 and the rear ring 228 may be configured to individually and/or collectively secure at least a portion of the scope therein. In some instances, the base member 202, the front ring 226, and/or the rear ring 228 may be separate components. In other instances, the base member 202, the front ring 226, and/or the rear ring 228 (or portions thereof) may be a single machined piece of metal or the like.

The scope mount assembly 200 may include at least one scope mount rail assembly 230 extending from the front ring 226 and/or the rear ring 228. In some instances, a plurality of scope mount rail assemblies 230 may extend from the front ring 226 and/or the rear ring 228. The at least one scope mount rail assembly 230 may comprise a picatinny rail or the like. The scope mount rail assembly 230 may extend from the front ring 226 in an orientation that is generally away from the rear ring 228. Likewise, the scope mount rail assembly 230 may extend from the rear ring 228 in an orientation that is generally away from the front ring 226. However, the scope mount rail assembly 230 may extend in any orientation.

The front ring 226 and/or the rear ring 228 may include one or more attachment/positioning devices 232 for attaching and/or positioning the scope mount rail assembly 230 thereon. For example, the attachment/positioning devices 232 may comprise an array of bores 234 or the like positioned about the periphery of the front ring 226 and/or the rear ring 228. The attachment/positioning devices 232 may be located about the front ring 226 and/or the rear ring 228 in discrete locations so as to enable the proper positioning and/or alignment of the scope mount rail assembly 230 to the front ring 226 and/or the rear ring 228. For instances, in certain embodiments, the attachment/positioning devices 232 may be disposed about the front ring 226 and/or the rear ring 228 at 0, 45, 90, 135, and/or 180 degree positions. The attachment/positioning devices 232 may be positioned at any location and at any degree or distance from one another. In some instances, the attachment/positioning devices 232 may be omitted.

The scope mount rail assembly 230 may include an attachment adapter 236 that corresponds to the attachment/positioning devices 232. In this manner, the scope mount rail assembly 230 may be attached to the front ring 226 and/or the rear ring 228 by coupling the attachment adapter 236 to the attachment/positioning devices 232. In some instances, the attachment adapter 236 may comprise a channel 238 formed between two parallel rims 240. The rims 240 may include one or more bores 242 extending therethrough. In this manner, the attachment adapter 236 and the attachment/positioning devices 232 may be coupled together such that one or more of the bores 234 of the attachment/positioning devices 232 and one or more of the bores 242 of the attachment adapter 236 align. A screw 244 or the like may be threaded through the aligned bores to secure the scope mount rail assembly 230 to the front ring 226 and/or the rear ring 228.

In certain embodiments, the channel 238 and/or rims 240 of the attachment adapter 236 may include an arcuate shape that corresponds to the curvature of the front ring 226 and/or the rear ring 228 so as to facilitate attachment thereto. In some instances, the channel 238 may include one or more crushable steps 246.

In some instances, the front ring 226 may comprise a top half 252 and a bottom half 254. In this manner, the top half 252 and the bottom half 254 of the front ring 226 may be configured to be fastened together and/or disassembled. Similarly, the rear ring 228 may comprise a top half 260 and a bottom half 262. In this manner, the top half 260 and the bottom half 262 of the rear ring 228 may be configured to be fastened together and/or disassembled. The configuration of the front ring 226 and the rear ring 228 may facilitate the installation of the scope to the scope mount assembly 200. In some instances, the bottom half 254 of the front ring 226 and/or the bottom half 262 of the rear ring 228 may be a single machined piece of metal or the like.

Figure 17:
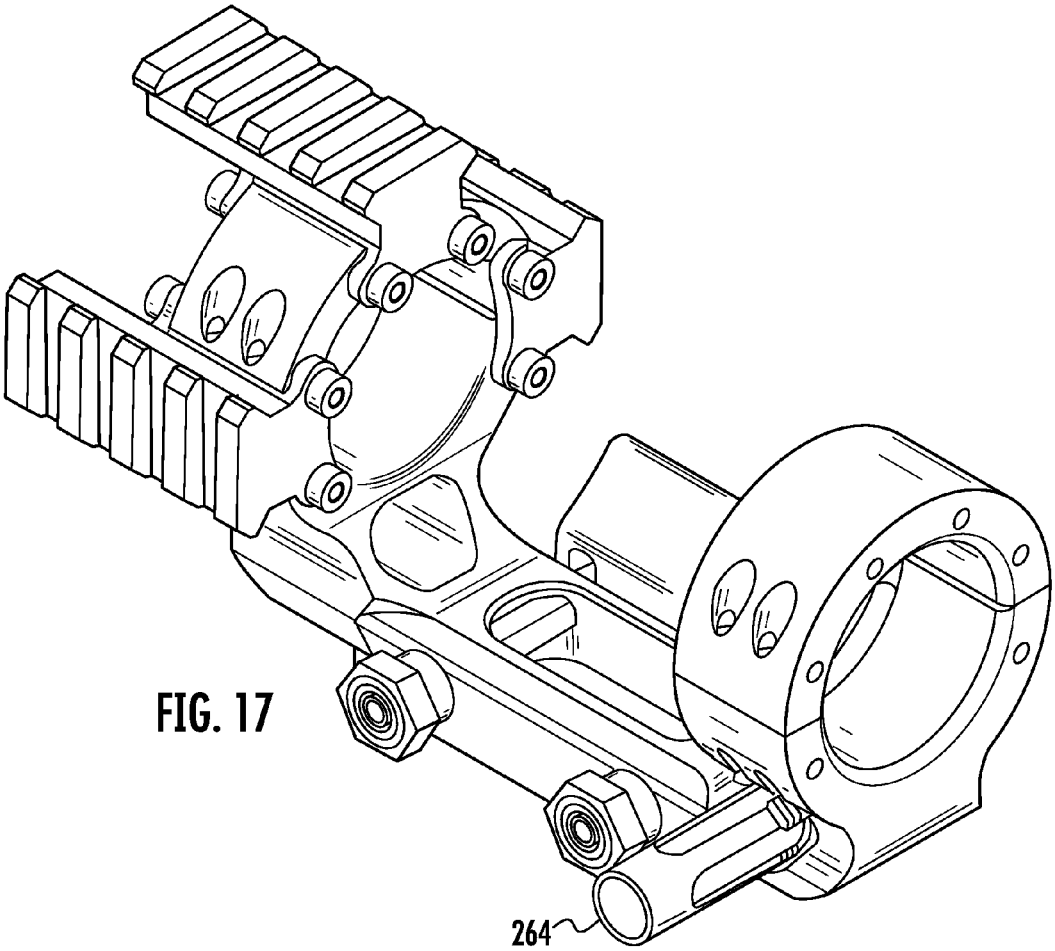
FIG. 17 schematically depicts a perspective view of a scope mount assembly in accordance with one or more embodiments of the disclosure.
Figure 18:
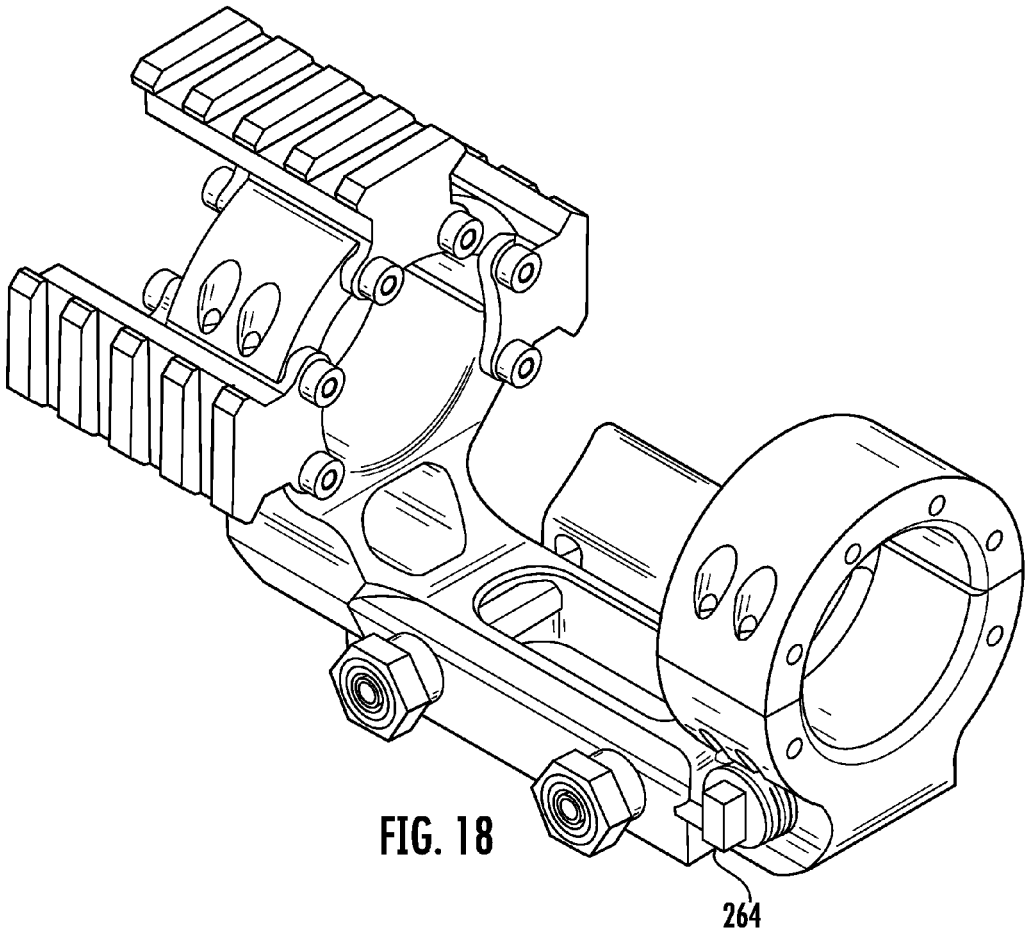
FIG. 18 schematically depicts a perspective view of a scope mount assembly in accordance with one or more embodiments of the disclosure.
Figure 19:
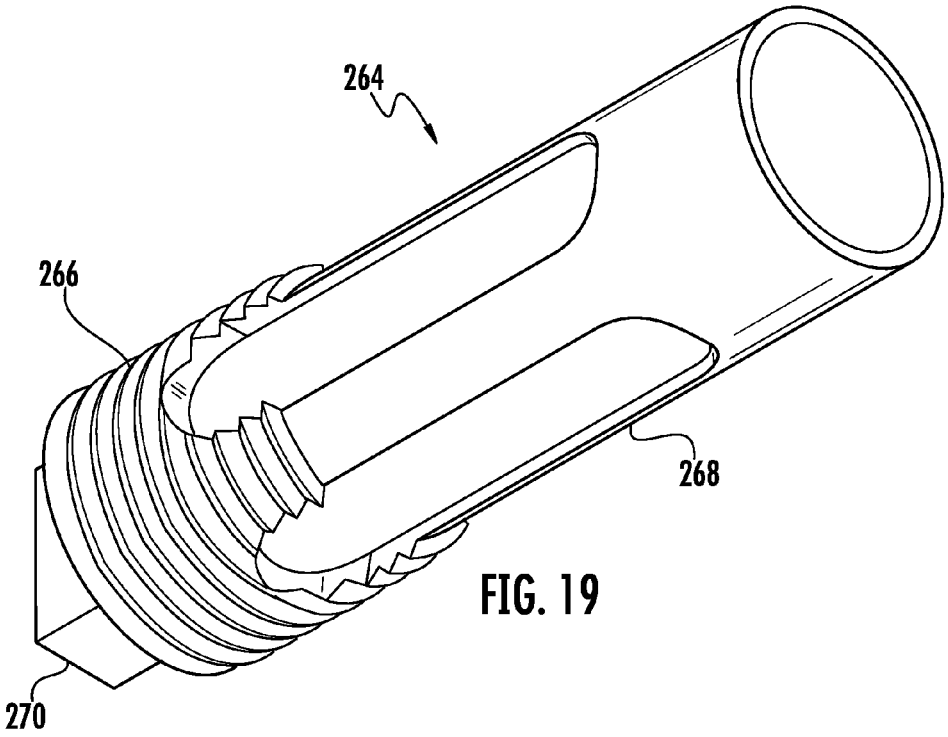
FIG. 19 schematically depicts a perspective view of a retractable bubble assembly in accordance with one or more embodiments of the disclosure.
Figure 20:
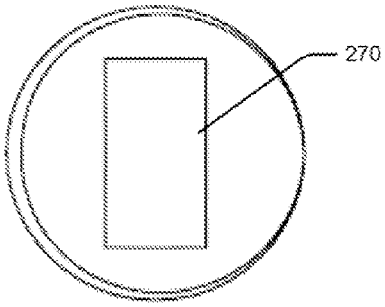
FIG. 20 schematically depicts a rear view of a retractable bubble assembly in accordance with one or more embodiments of the disclosure.
Figure 21:
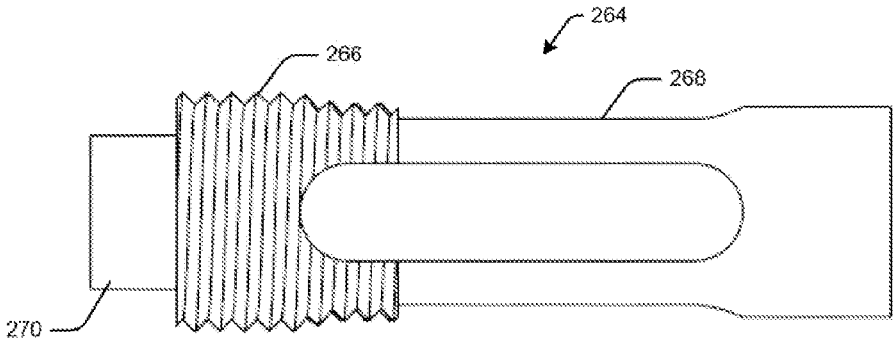
FIG. 21 schematically depicts side view of a retractable bubble assembly in accordance with one or more embodiments of the disclosure.
Figure 22:
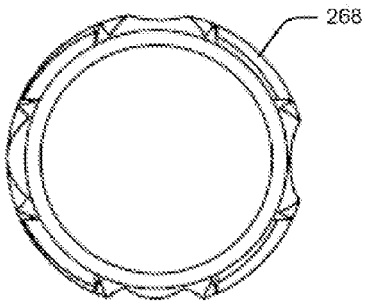
FIG. 22 schematically depicts a front view of a retractable bubble assembly in accordance with one or more embodiments of the disclosure.

In other embodiments, the scope mount assembly 200 may include an adaptable slot 248 configured to at least partially receive a retractable bubble level 264 or the like. In some instances, as depicted in FIG. 18, the retractable bubble level 264 may be at least partially housed within the adaptable slot 248. In other instances, as depicted in FIG. 17, the retractable bubble level 264 may extend from the adaptable slot 248. For example, the retractable bubble level 264 may include a threaded portion 266. The threaded portion 266 may be configured to be threaded into the adaptable slot 248. In this manner, the adaptable slot 248 may include corresponding internal threads. A bubble lever portion 268 may extend from the threaded portion 266 in a first direction. The bubble lever portion 268 may include a bubble level or the like for leveling the scope mount assembly 200. The bubble lever portion 268 may have a smaller outer diameter than the threaded portion 266. A knob 270 may extend from the threaded portion 266 in a second direction that is opposite the first direction. In some instances, the knob 270 may be configured to cooperate with a tool or the like to thread the threaded portion 266 into and out of the adaptable slot 248. In other instances, the knob 270 may be configured to be grasped by a user.

In certain embodiments, the bubble lever portion 268 may be at least partially housed within the adaptable slot 248. The bubble lever portion 268 may be housed within the adaptable slot 248 during storage, transportation, and/or after the scope mount assembly 200 has been leveled (i.e., calibrated). For example, the bubble lever portion 268 may be positioned within the adaptable slot 248, and the knob 270 may be turned to thread the bubble lever portion 268 further into the adaptable slot 248. In other embodiments, the knob 270 may be at least partially housed within the adaptable slot 248. When the knob 270 is housed within the adaptable slot 248, the bubble lever portion 268 may extend from the adaptable slot 248. In such instances, the bubble level associated with the bubble lever portion 268 may be utilized by a user to level (i.e., calibrated) the scope mount assembly 200. In this manner, the retractable bubble level 264 may be carried with the scope mount housing 200.

Figure 23:
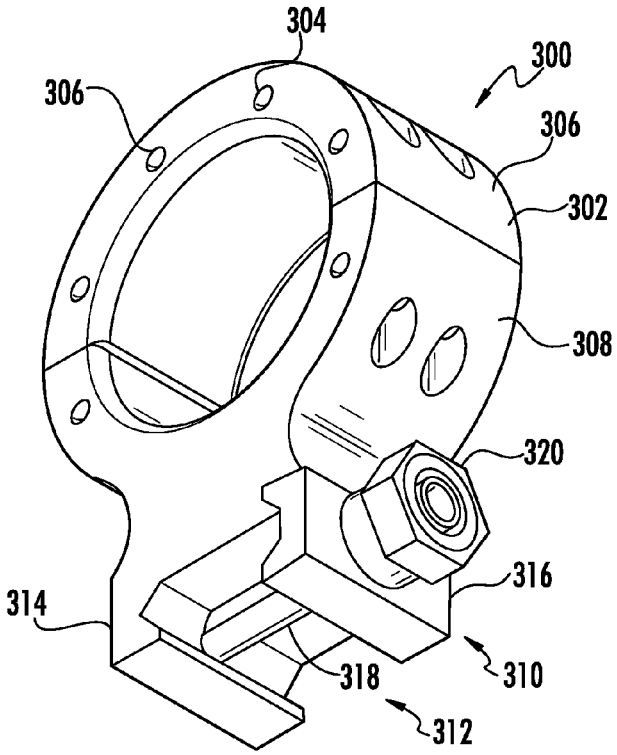
FIG. 23 schematically depicts a perspective view of a scope mount assembly in accordance with one or more embodiments of the disclosure.
Figure 24:
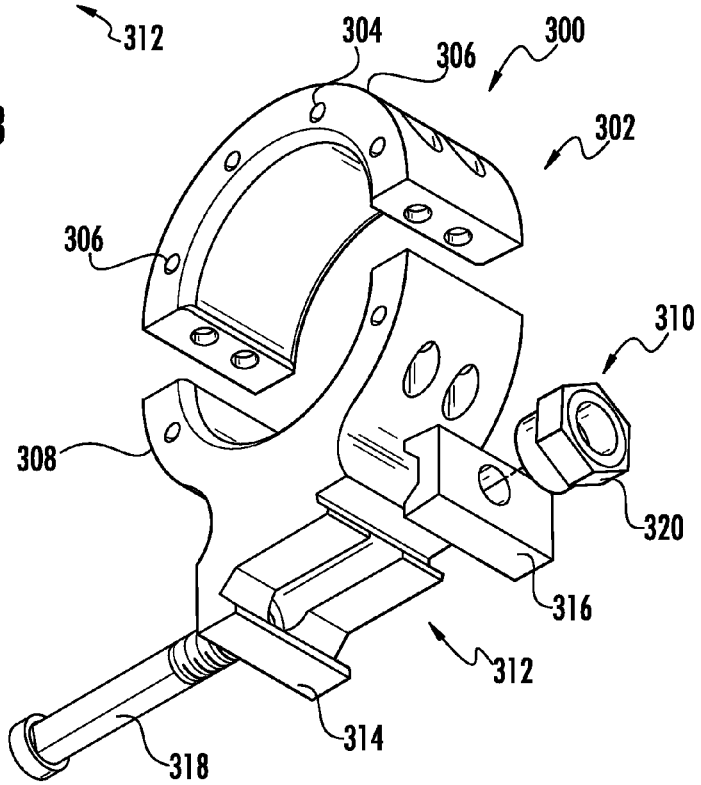
FIG. 24 schematically depicts a partially exploded perspective view of a scope mount assembly in accordance with one or more embodiments of the disclosure.

FIGS. 23 and 24 schematically depict a scope mount assembly 300 (as well as individual components of the scope mount assembly 300) that can be attached to a firearm in accordance with one or more embodiments of the disclosure. The scope mount assembly 300 may include a scope mount ring 302. The scope mount ring 302 may be configured to secure at least a portion of the scope therein.

The scope mount ring 302 may include at least one scope mount rail assembly, like those described above with reference to FIGS. 13-16, extending from the scope mount ring 302. In some instances, a plurality of scope mount rail assemblies may extend from the scope mount ring 302.

The scope mount ring 302 may include one or more attachment/positioning devices 304 for attaching and/or positioning the scope mount rail assembly thereon. For example, the attachment/positioning devices 304 may comprise an array of bores 306 or the like positioned about the periphery of the scope mount ring 302. The attachment/positioning devices 304 may be located about the scope mount ring 302 in discrete locations so as to enable the proper positioning and/or alignment of the scope mount rail assembly to the scope mount ring 302. For instances, in certain embodiments, the attachment/positioning devices 304 may be disposed about the scope mount ring 302 at 0, 45, 90, 135, and/or 180 degree positions. The attachment/positioning devices 304 may be positioned at any location and at any degree or distance from one another. In some instances, the attachment/positioning devices 304 may be omitted.

In some instances, the scope mount ring 302 may comprise a top half 306 and a bottom half 308. In this manner, the top half 306 and the bottom half 308 of the scope mount ring 302 may be configured to be fastened together and/or disassembled.

In certain embodiments, the scope mount ring 302 may include an attachment mechanism 310. The attachment mechanism 310 may be configured to removeably attach the scope mount ring 302 to the rail assembly of the firearm. That is, in some instances, the attachment mechanism 310 may be configured to be attached to a picatinny rail or the like. For example, the attachment mechanism 310 may comprise a clamp assembly 312. In some instances, the clamp assembly 312 may include a fixed clamp 314 and a moveable clamp 316. The moveable clamp 316 may be operable to move relative to the fixed clamp 314 between a clamped position and an unclamped position. In certain embodiments, at least one coupling rod 318 may couple the fixed clamp 314 and the moveable clamp 316. In this manner, adjustment of the coupling rod 318 may move the moveable clamp 316. For example, the coupling rod 318 may be operable to be manipulated by a user or a tool. That is, the user may twist the coupling rod 318. In this manner, movement of the coupling rod 318 by the user may move the clamp assembly 312 between the clamped position and the unclamped position. For example, one or more lugs 320 may be tightened or loosened in conjunction with the at least one coupling rod 318 to increase or decrease a clamping force of the clamping assembly 312. In some aspects, the at least one coupling rod 318 may be configured to at least partially protrude between at least two mounting projections on the rail assembly of the firearm when attached thereto. In this manner, the at least one coupling rod 318 may prevent the scope mount ring 302 from sliding along the rail assembly of the firearm when attached thereto. In certain embodiments, a silhouette of the clamp assembly 312 may correspond to a profile of the rail assembly of the firearm. That is, the silhouette of the clamp assembly 312 may be configured to mate with the profile of the rail assembly of the firearm.

Figure 25:
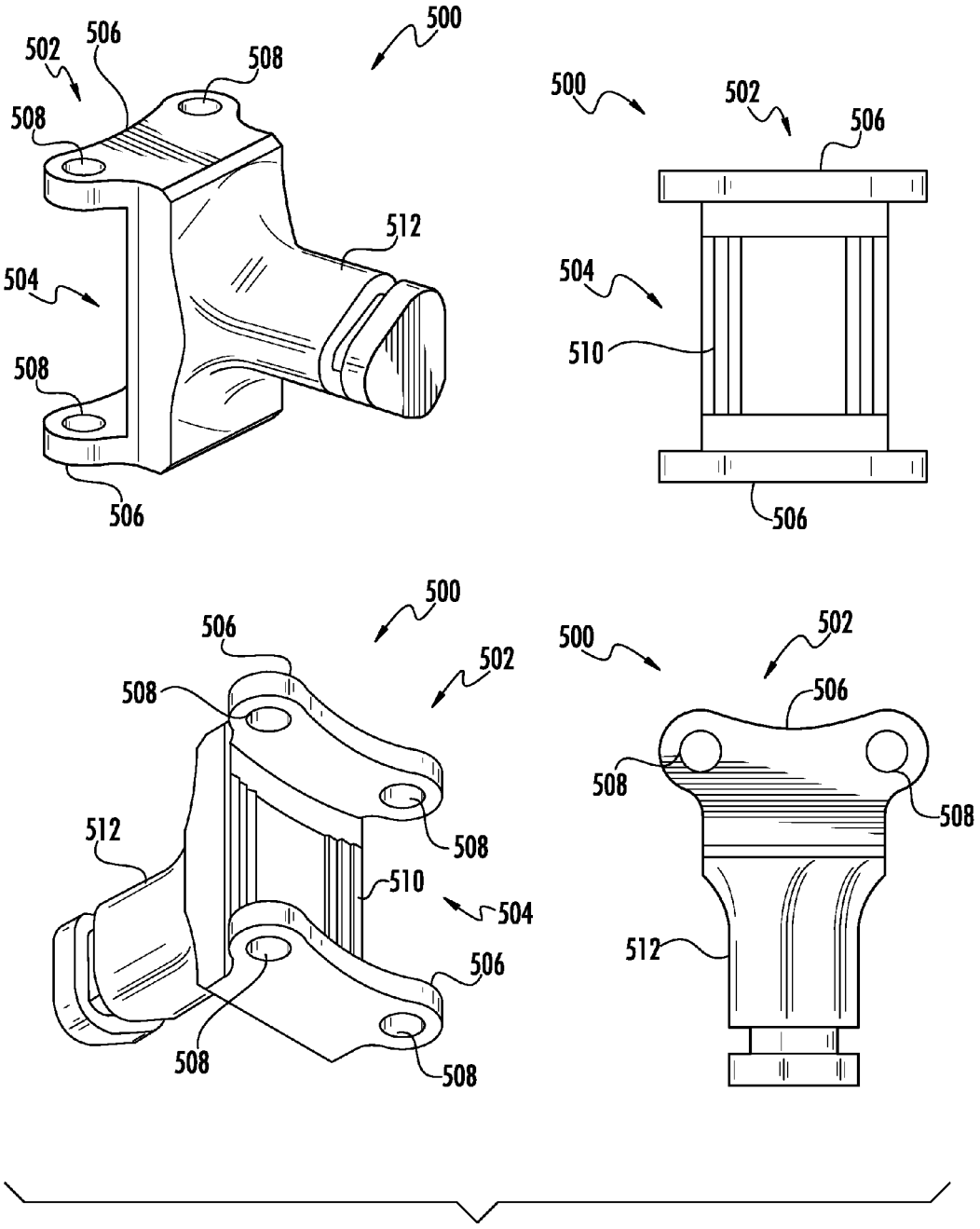
FIG. 25 schematically depicts various perspective views of a scope mount accessory in accordance with one or more embodiments of the disclosure.
Figure 26:
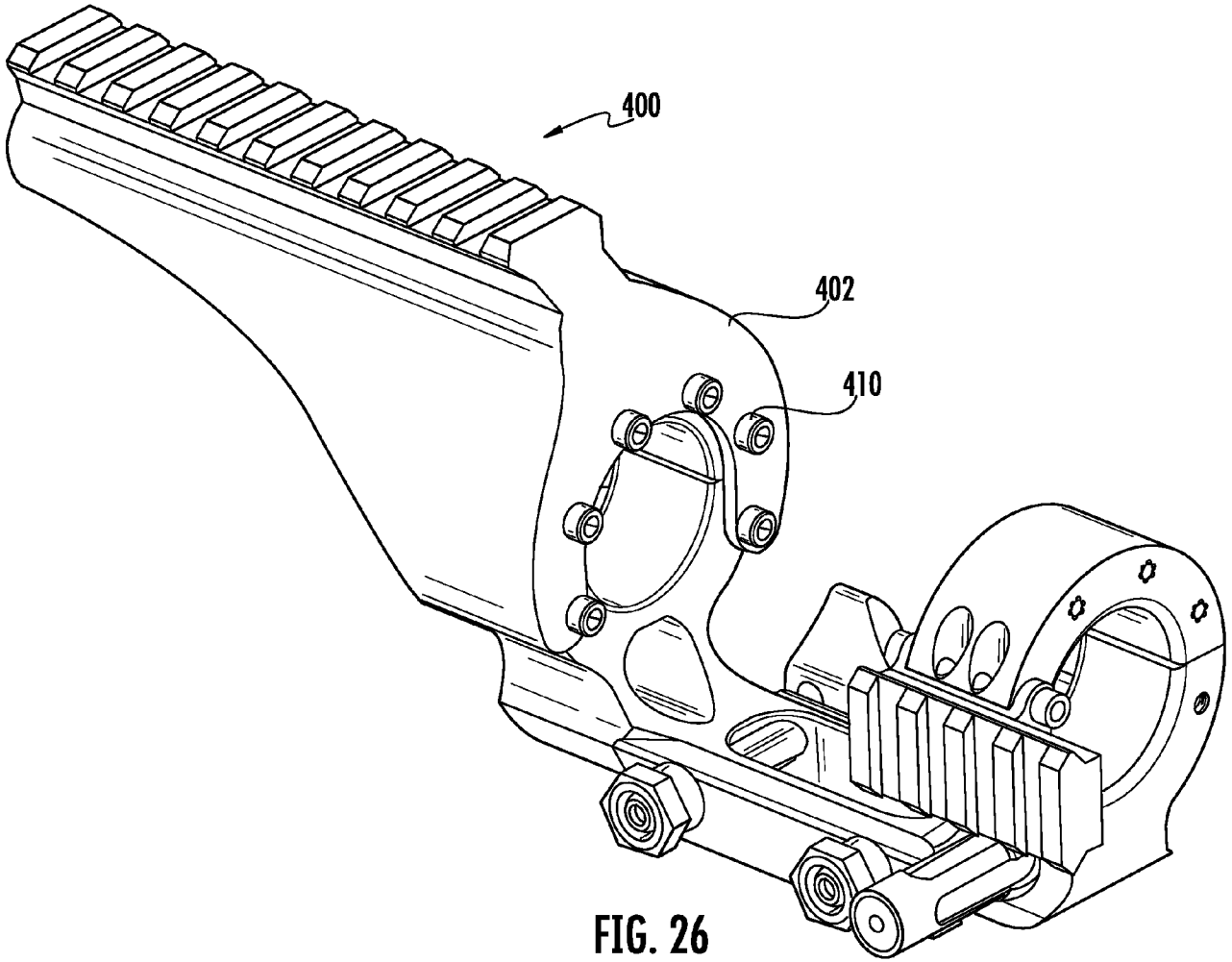
FIG. 26 schematically depicts a perspective view of a scope mount assembly in accordance with one or more embodiments of the disclosure.
Figure 27:
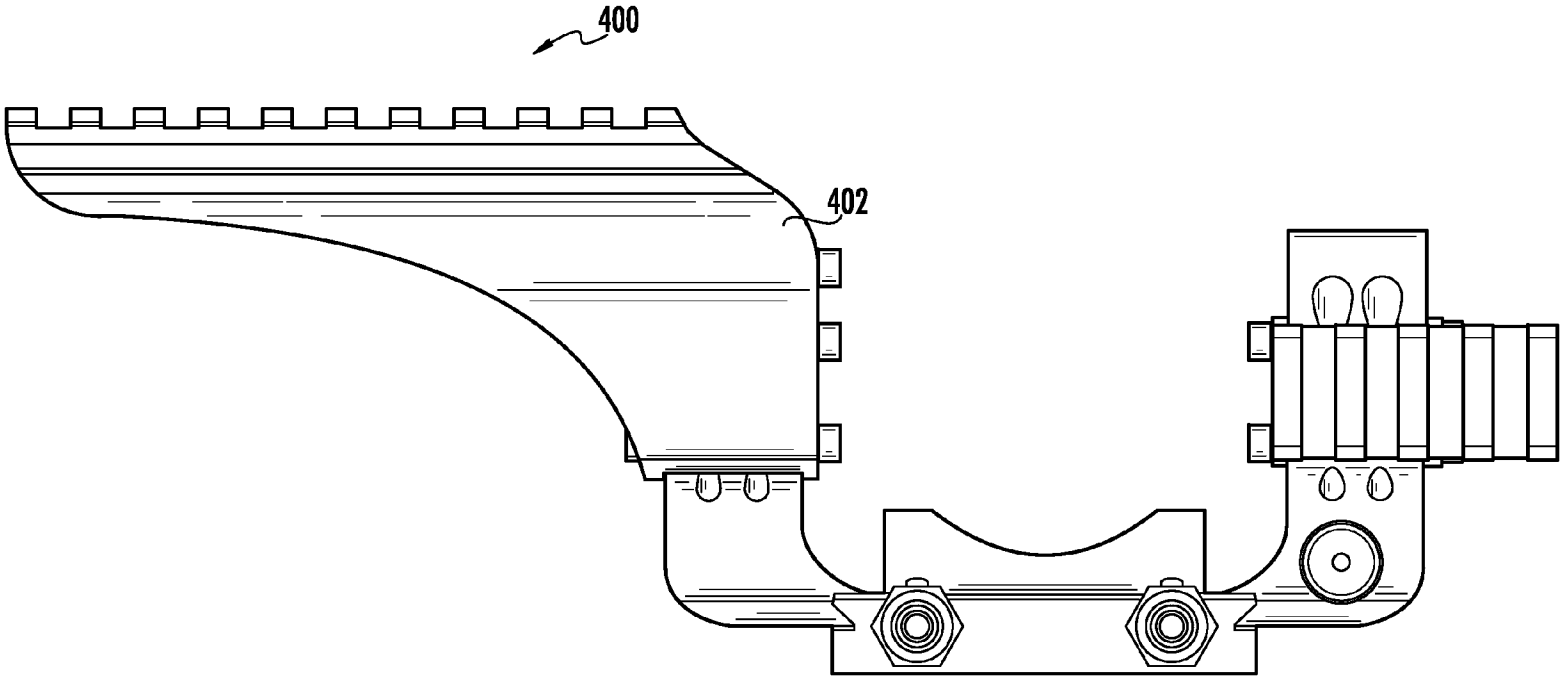
FIG. 27 schematically depicts a side view of a scope mount assembly in accordance with one or more embodiments of the disclosure.
Figure 28:
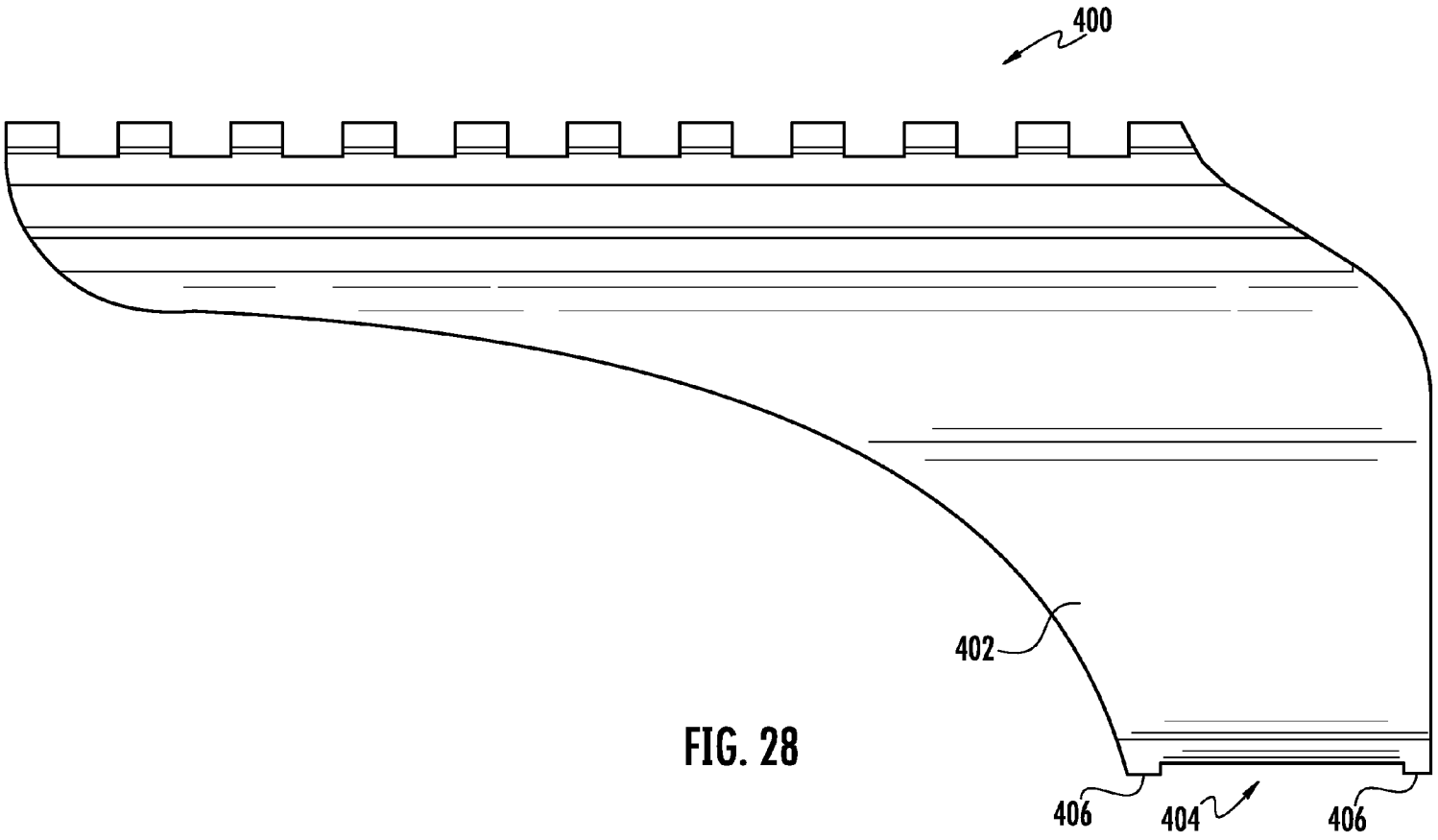
FIG. 28 schematically depicts a side view of a portion of a scope mount assembly in accordance with one or more embodiments of the disclosure.
Figure 29:
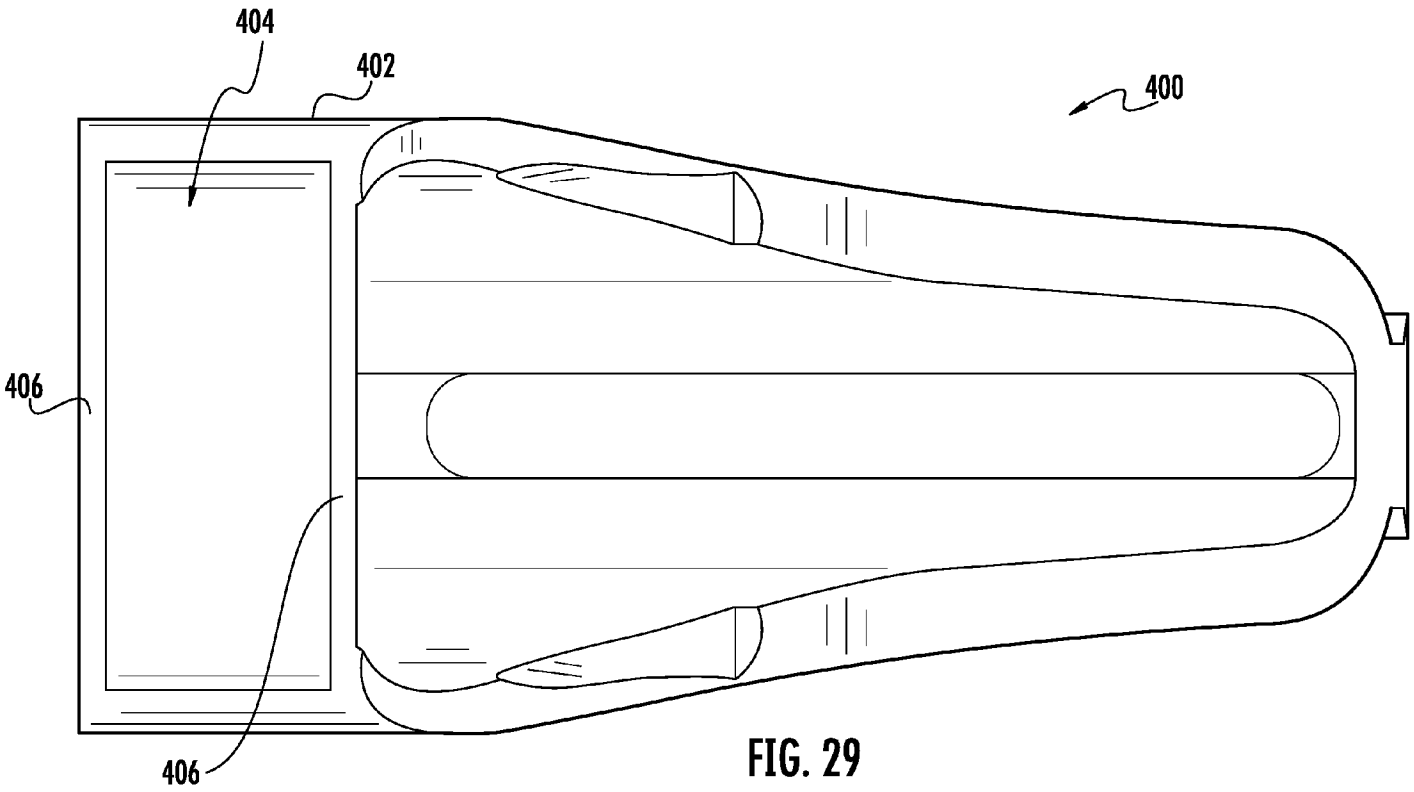
FIG. 29 schematically depicts a bottom view of a portion of a scope mount assembly in accordance with one or more embodiments of the disclosure.
Figure 30:
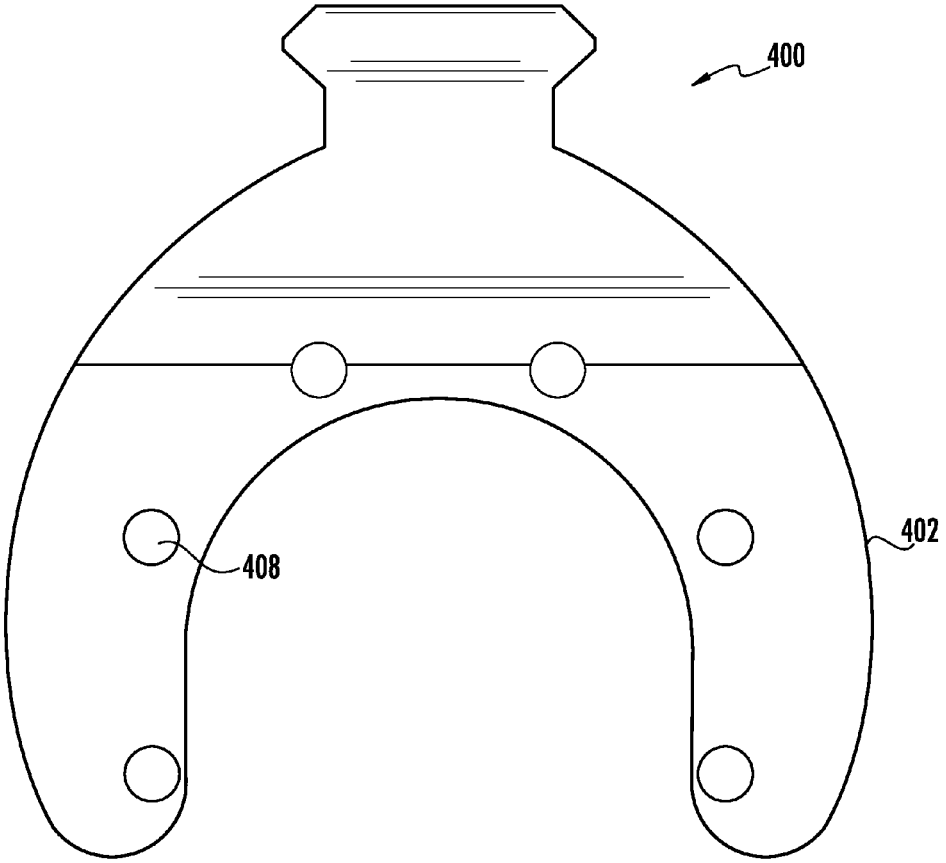
FIG. 30 schematically depicts a rear view of a portion of a scope mount assembly in accordance with one or more embodiments of the disclosure.

FIG. 25 schematically depicts various perspective views of an example scope mount accessory 500 that may be attached to the scope mount assembly 200. For example, the scope mount accessory 500 may comprise a device for attaching a personal digital assistant or the like to the scope mount assembly 200. In some instances, the scope mount accessory 500 may include an attachment adapter 502 that corresponds to the attachment/positioning devices 232. In this manner, the scope mount accessory 500 may be attached to the front ring 226 and/or the rear ring 228 by coupling the attachment adapter 502 to the attachment/positioning devices 232. In some instances, the attachment adapter 502 may comprise a channel 504 formed between two parallel rims 506. The channel 504 may be configured to be positioned about the front ring 226 and/or the rear ring 228. That is, the channel 504 may receive at least a portion of the front ring 226 and/or the rear ring 228. The rims 506 may include one or more bores 508 extending therethrough. In this manner, the attachment adapter 502 and the attachment/positioning devices 232 may be coupled together such that one or more of the bores 234 of the attachment/positioning devices 232 and one or more of the bores 508 of the attachment adapter 502 align. A screw or the like may be threaded through the aligned bores to secure the scope mount accessory 500 to the front ring 226 and/or the rear ring 228.

In certain embodiments, the channel 504 and/or rims 506 of the attachment adapter 502 may include an arcuate shape that corresponds to the curvature of the front ring 226 and/or the rear ring 228 so as to facilitate attachment thereto. In some instances, the channel 238 may include one or more crushable steps 510. The scope mount accessory 500 may include a protrusion 512 extending from the attachment adapter 502. The protrusion 512 may be configured to be attached to one or more accessories, such as a personal digital assistant.

FIGS. 26-30 schematically depict a scope mount rail assembly 400 as may be used herein. The scope mount rail assembly 400 is a more robust rail assembly than those previously discussed. For example, the scope mount rail assembly 400 may be attached directly to a scope mount assembly in the same plane as the scope mount assembly and the scope. The scope mount rail assembly 400 may reduce the shock of recoil on peripheral devices and also may be able to hold larger/heavier devices than the smaller scope mount rail assemblies previously discussed.

In some instances, the scope mount rail assembly 400 may be attached to the scope mount assembly 200. For example, the scope mount rail assembly 400 may extend from the front ring 226 and/or the rear ring 228. The scope mount rail assembly 400 may comprise a picatinny rail or the like about its top surface. The scope mount rail assembly 400 may extend from the front ring 226 in an orientation that is generally away from the rear ring 228. Likewise, the scope mount rail assembly 400 may extend from the rear ring 228 in an orientation that is generally away from the front ring 226. However, the scope mount rail assembly 400 may extend in any orientation. In some instances, when attached to the scope mount assembly 200, the scope mount rail assembly 400 may be at least partially positioned around a scope housed within the scope mount assembly 200.

The scope mount rail assembly 400 may include an attachment adapter 402 that corresponds to the attachment/positioning devices 232. In this manner, the scope mount rail assembly 400 may be attached to the front ring 226 and/or the rear ring 228 by coupling the attachment adapter 402 to the attachment/positioning devices 232. In some instances, the attachment adapter 402 may comprise a channel 404 formed between two parallel rims 406. The channel 404 may be configured to be positioned about the front ring 226 and/or the rear ring 228. That is, the channel 404 may receive at least a portion of the front ring 226 and/or the rear ring 228. The rims 406 may include one or more bores 408 extending therethrough. In this manner, the attachment adapter 402 and the attachment/positioning devices 232 may be coupled together such that one or more of the bores 234 of the attachment/positioning devices 232 and one or more of the bores 408 of the attachment adapter 402 align. A screw 410 or the like may be threaded through the aligned bores to secure the scope mount rail assembly 400 to the front ring 226 and/or the rear ring 228. In certain embodiments, the channel 404 and/or rims 406 of the attachment adapter 402 may include an arcuate shape that corresponds to the curvature of the front ring 226 and/or the rear ring 228 so as to facilitate attachment thereto.

Certain aspects of the various embodiments of FIGS. 1-30 may be omitted and/or combined with other aspects described herein. For example, any of the features or structures described with reference to the embodiment described in FIGS. 1-6 may be incorporated into the embodiment described in FIGS. 8-30 and vice versa. That is, any of the components of the various embodiments may be interchangeable between the various embodiments.

Illustrative Methods

Figure 7:
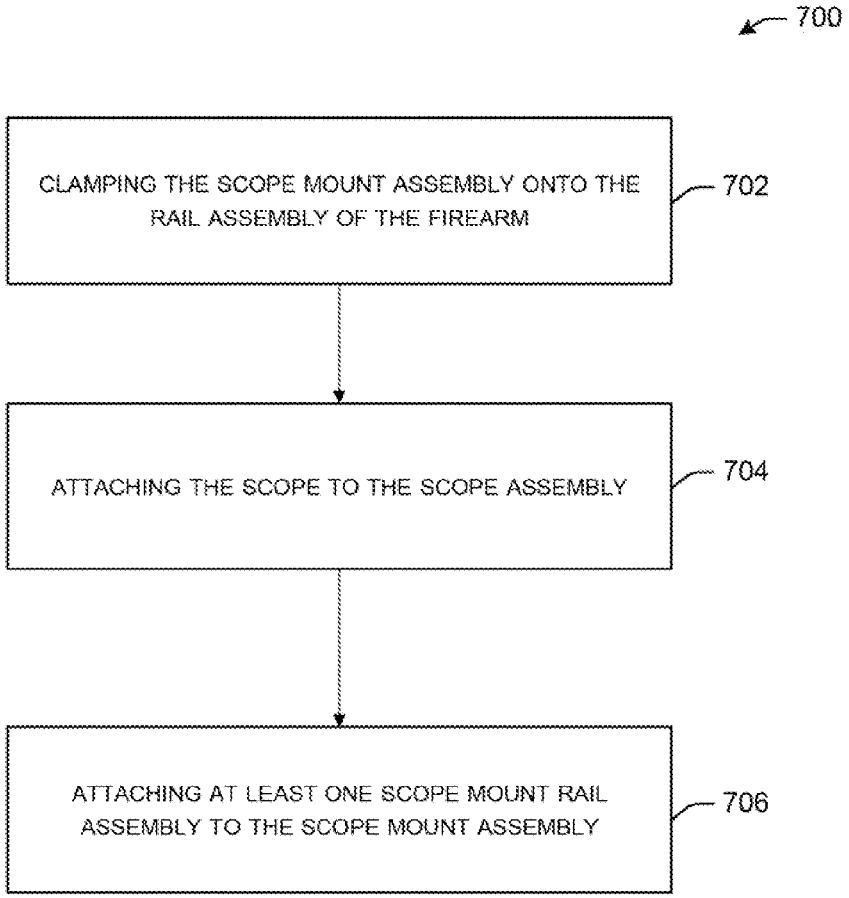
FIG. 7 is a flow diagram depicting an illustrative method for attaching a scope mount assembly to a firearm in accordance with one or more embodiments of the disclosure.
Figure 8:
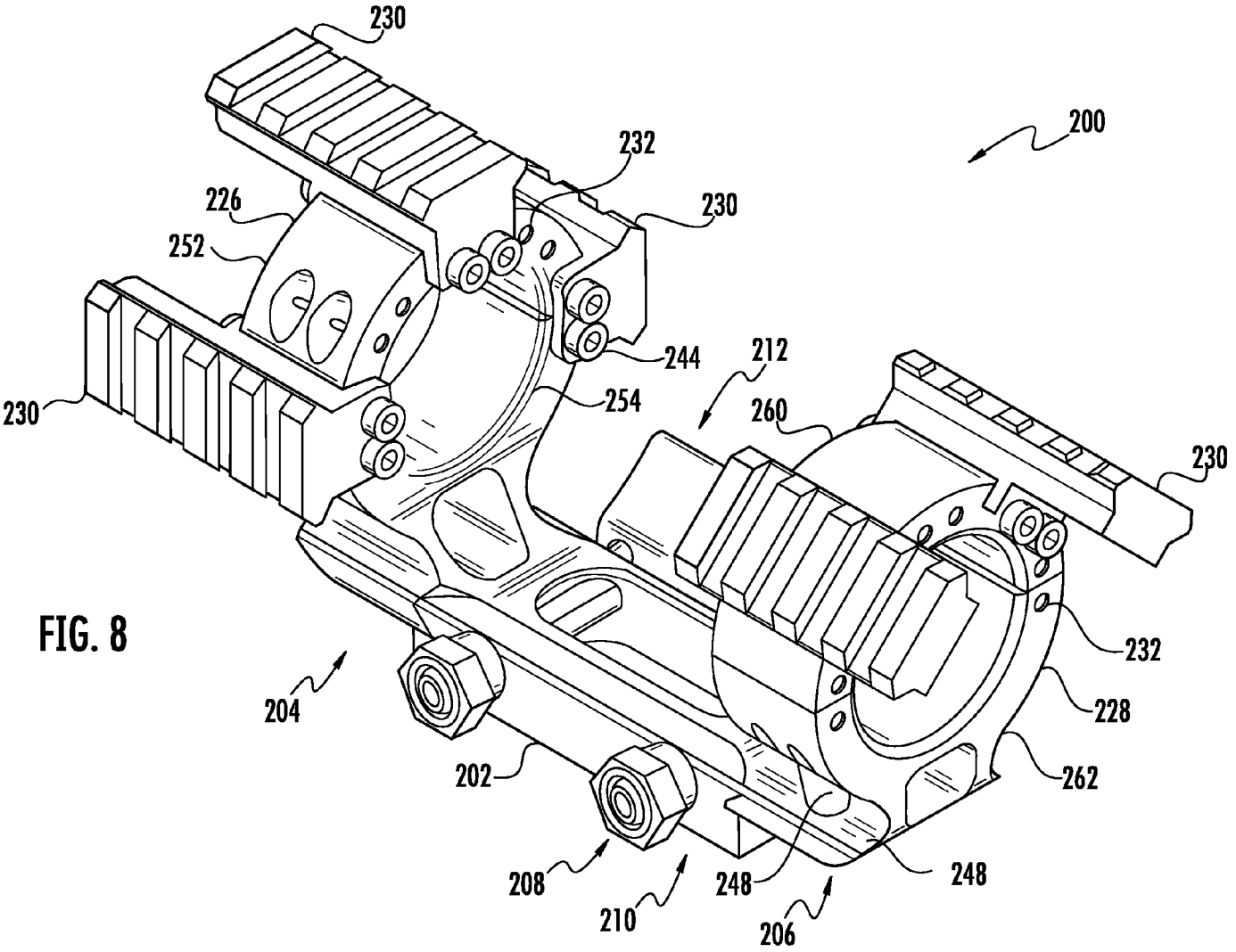
FIG. 8 schematically depicts a perspective view of a scope mount assembly in accordance with one or more embodiments of the disclosure.
Figure 9:
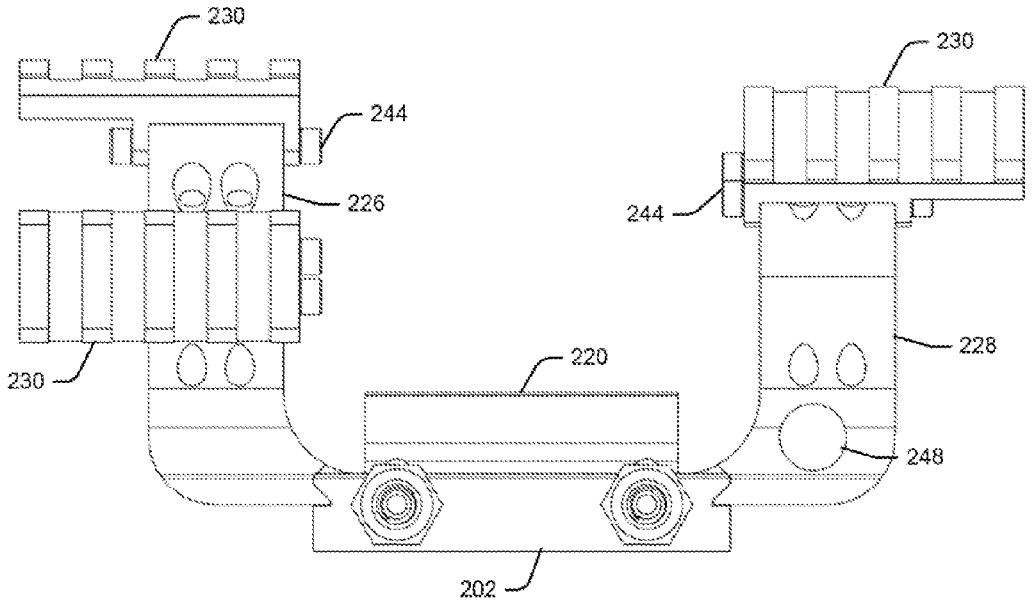
FIG. 9 schematically depicts a side view of a scope mount assembly in accordance with one or more embodiments of the disclosure.
Figure 10:
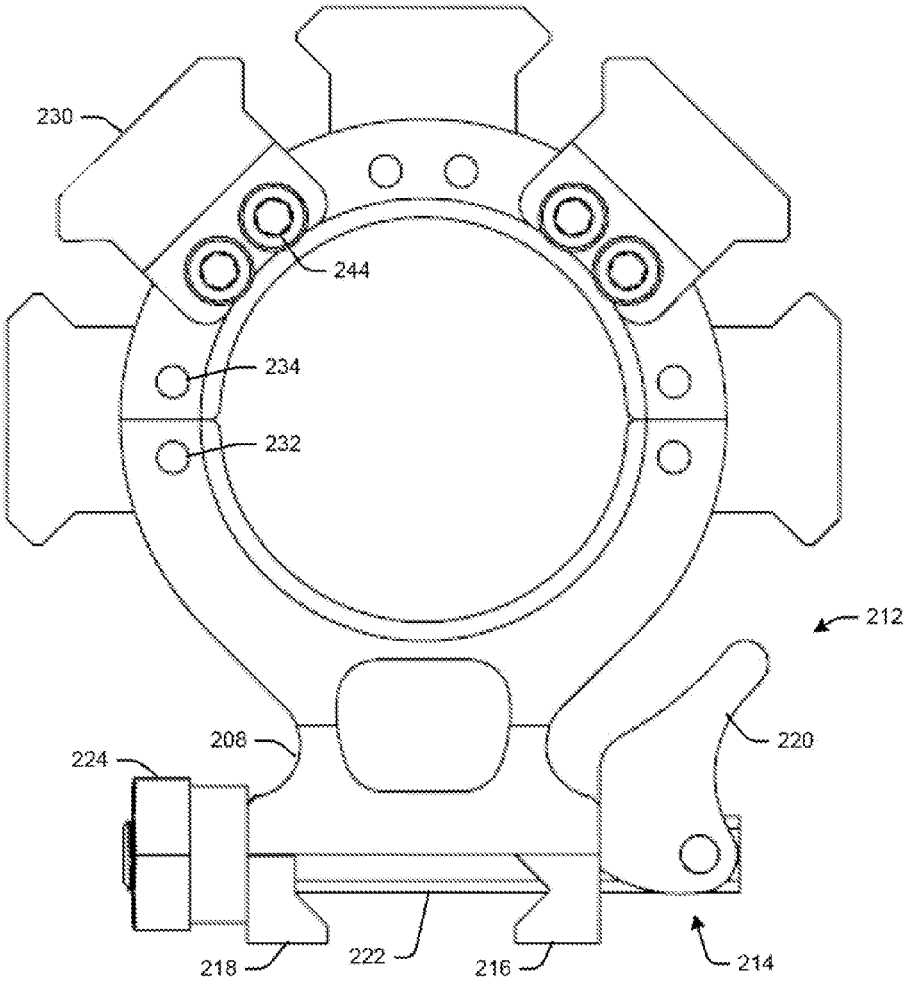
FIG. 10 schematically depicts a back view of a scope mount assembly in accordance with one or more embodiments of the disclosure.
Figure 11:
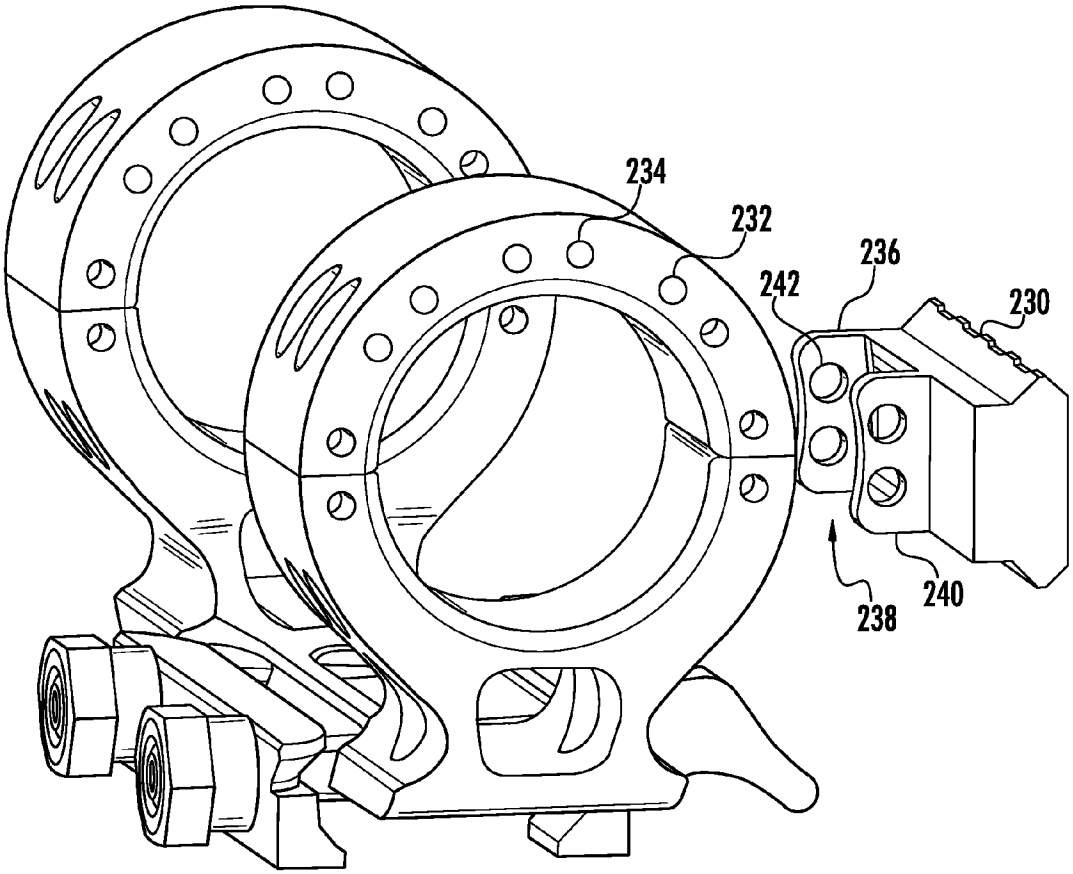
FIG. 11 schematically depicts a partially exploded perspective view of a scope mount assembly in accordance with one or more embodiments of the disclosure.
Figure 12:
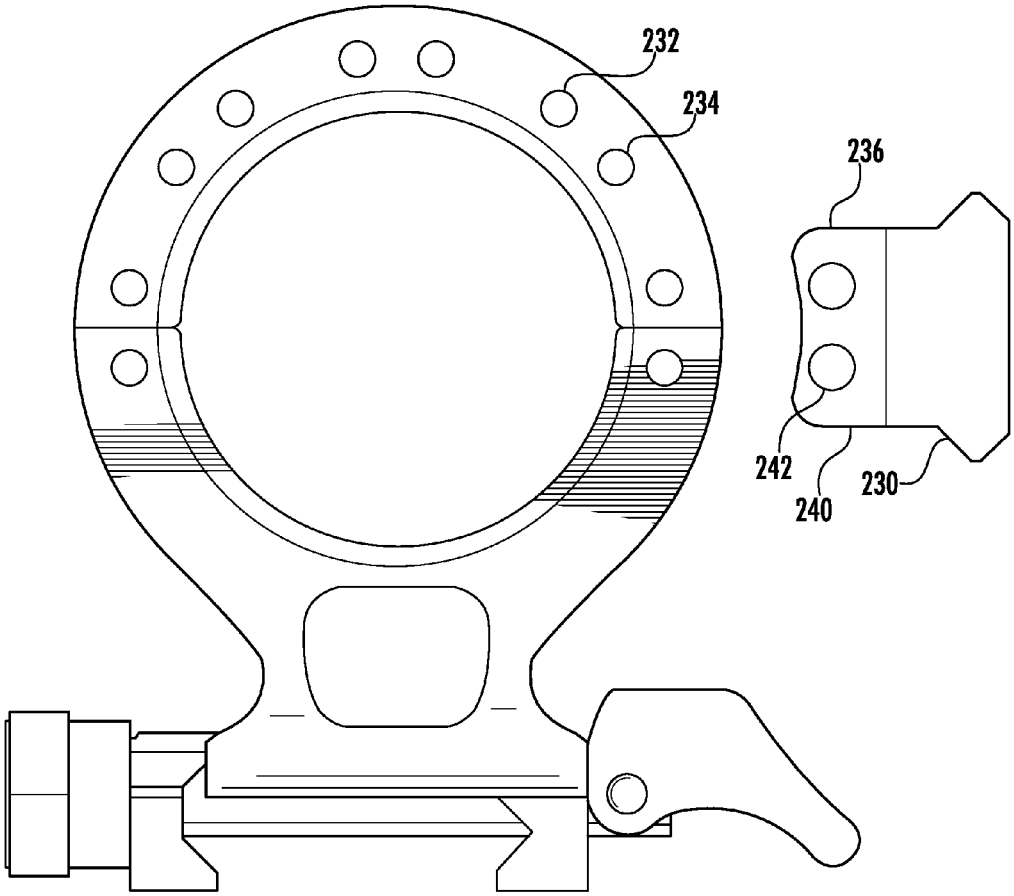
FIG. 12 schematically depicts a partially exploded back view of a scope mount assembly in accordance with one or more embodiments of the disclosure.
Figure 13:
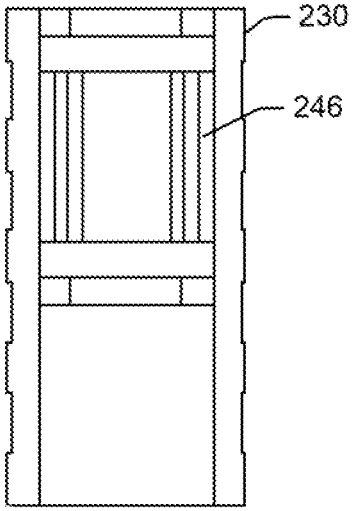
FIG. 13 schematically depicts a bottom view of a portion of a scope mount assembly in accordance with one or more embodiments of the disclosure.
Figure 14:
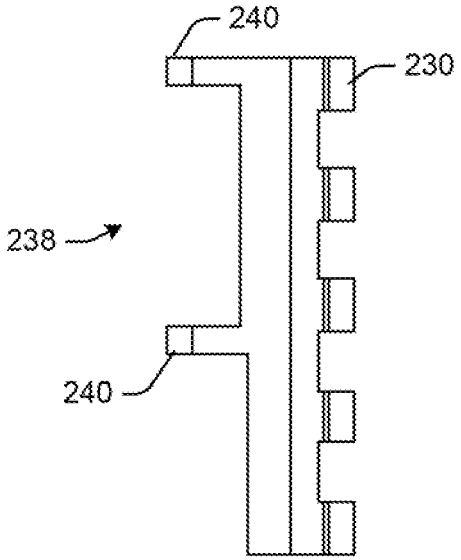
FIG. 14 schematically depicts a top view of a portion of a scope mount assembly in accordance with one or more embodiments of the disclosure.
Figure 15:
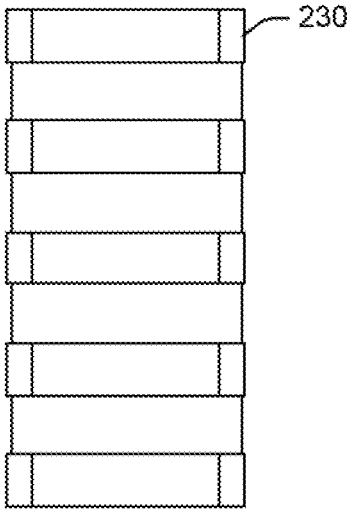
FIG. 15 schematically depicts a side view of a portion of a scope mount assembly in accordance with one or more embodiments of the disclosure.
Figure 16:
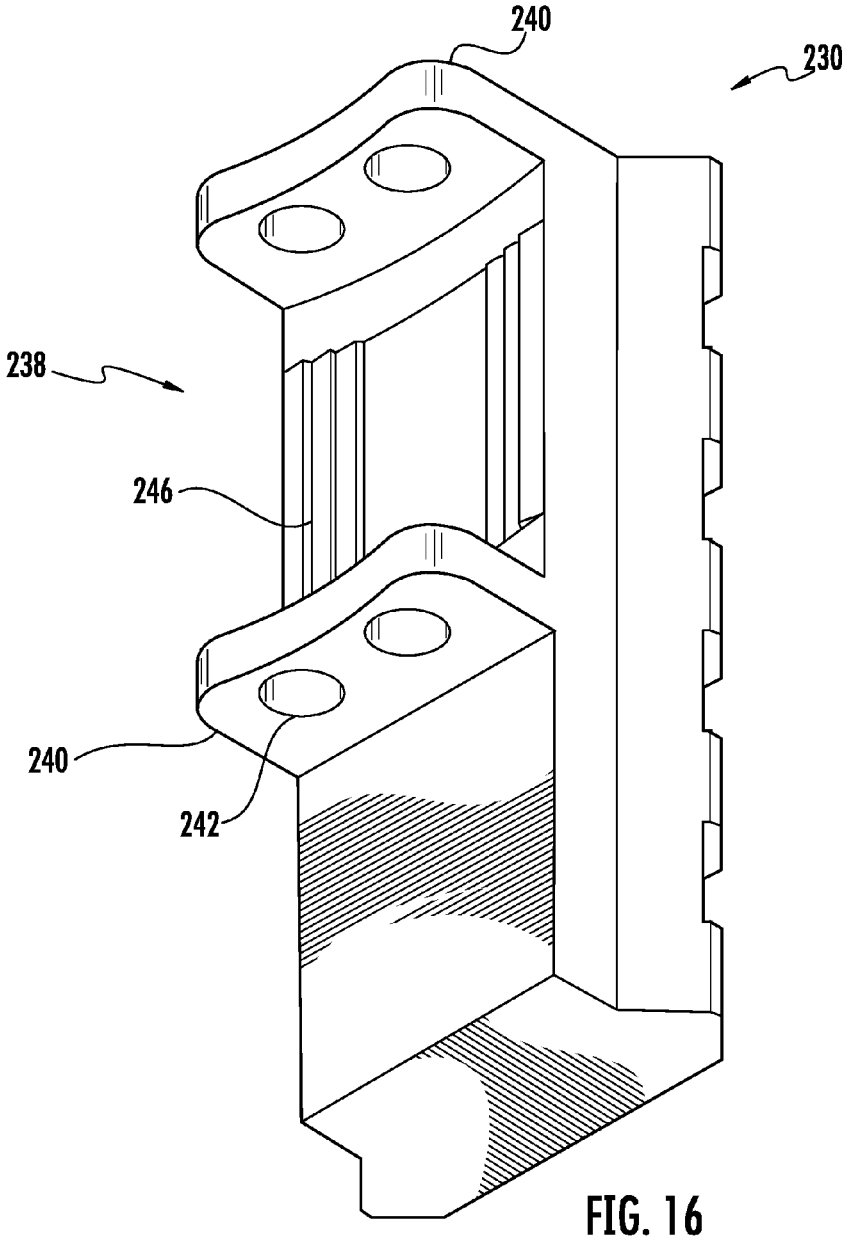
FIG. 16 schematically depicts a perspective view of a portion of a scope mount assembly in accordance with one or more embodiments of the disclosure.

FIG. 7 is a flow diagram depicting an illustrative method 700 for removeably attaching a scope to a firearm in accordance with one or more embodiments of the disclosure. FIG. 7 is described with reference to FIGS. 1-6. However, FIG. 7 could equally be described with reference to FIGS. 8-30 or a combination of FIGS. 1-6 and 8-30.

At block 702 of method 700, the scope mount assembly 100 may be clamped onto the rail assembly of the firearm. For example, the base member 102 of the scope mount assembly 100 may include an attachment mechanism 108, such as a clamp assembly 110 and a lever assembly 112. The attachment mechanism 108 may be configured to removeably attach the base member 102 to the rail assembly (e.g., a picatinny rail) of the firearm. The lever assembly 112 may be operable to move the clamp assembly 110 between the clamped position and the unclamped position. For example, the clamp assembly 110 and the lever assembly 112 may be in mechanical communication by way of a cam-type mechanism 114 or the like. In certain embodiments, the user may move the lever 120 up and down. For example, the lever 120 may be manipulated down and away from the scope to the unlocked position. Conversely, the lever 120 may be manipulated upward towards the scope to the locked position. When in the locked position, at least a portion of the lever 120 may nest adjacent to the scope secured within the scope mount assembly 100. This configured may prevent the user from unintentionally moving the lever 120 to the unlocked position.

Upon clamping the scope mount assembly 100 to the rail assembly of the firearm at block 702, the scope may be attached to the scope mount assembly 100 at block 704. For example, the front ring 126 and the rear ring 128 may be configured to individually and/or collectively secure at least a portion of the scope therein. In some instances, the top half 152 of the front ring 126 and/or the top half 160 of the rear ring 128 may be removed to facilitate attaching the scope to the front ring 126 and/or the rear ring 128.

At block 706 of method 700, the at least one scope mount rail assembly 130 may be attached to the scope mount assembly 100. For example, the scope mount rail 130 may extend from the front ring 126 in an orientation that is generally away from the rear ring 128. In some instances, the at least one scope mount rail assembly 130 may comprise a top rail assembly 132 extending from a top portion 134 (e.g., a 12:00 o'clock position) of the front ring 126. In other instances, the at least one scope mount rail assembly 130 may comprise a removable first side rail assembly 136 extending from a first side 138 (e.g., a 3:00/6:00 o'clock position) of the front ring 126. Moreover, the at least one scope mount rail assembly 130 may comprise a removable second side rail assembly 140 extending from a second side 142 (e.g., a 3:00/6:00 o'clock position) of the front ring 126. The at least one scope mount rail assembly 130 may comprise a picatinny rail or the like. The scope mount rail 130 assembly may be attached to the front ring 126 by way of a dovetail assembly or the like. Moreover, the scope mount rail 130 may be secured to the front ring 126 by way of the cap screw 148 or the like, although any securing mechanism may be used.

In certain embodiments, the scope may be attached to the scope mount assembly 100, and the scope mount assembly then may be attached to the rail assembly of the firearm. Moreover, the scope mount rail 130 may be attached to the front ring 126 at any time. That is, the steps described in blocks 702-706 of method 700 may be performed in any order. Moreover, certain steps may be omitted, while other steps may be added.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A scope mount assembly for removeably attaching a scope to a firearm, the firearm comprising a rail assembly, the scope mount assembly comprising:

a base member;

at least one ring extending from the base member, wherein the at least one ring is configured to secure at least a portion of the scope therein; and at least one removable scope mount rail assembly extending from the ring, wherein the at least one ring comprises one or more attachment/positioning devices for attaching and/or positioning the at least one removable scope mount rail assembly thereon, wherein the at least one removable scope mount rail assembly comprises an attachment adapter that corresponds to the attachment/positioning devices, wherein the attachment adapter comprises a channel formed between two parallel rims, and wherein the rims comprises one or more bores extending therethrough.

2. The scope mount assembly of claim 1, wherein the attachment/positioning devices comprise an array of bores positioned about the periphery of the at least one ring.

3. The scope mount assembly of claim 1, wherein the channel comprises one or more crushable steps.

4. The scope mount assembly of claim 1, wherein the at least one removable scope mount rail assembly extends beyond the at least one ring towards a muzzle end of the firearm.

5. A scope mount assembly for removeably attaching a scope to a firearm, the firearm comprising a rail assembly, the scope mount assembly comprising:

a base member comprising a front portion and a rear portion;

a front ring extending from the front portion of the base member, wherein the front ring is configured to secure at least a portion of the scope therein; and at least one removable scope mount rail assembly extending from the front ring, wherein the front ring comprise one or more attachment/positioning devices for attaching and/or positioning the at least one removable scope mount rail assembly thereon, wherein the attachment/positioning devices comprise an array of bores positioned about the periphery of the at least one ring, wherein the at least one removable scope mount rail assembly comprises an attachment adapter that corresponds to the attachment/positioning devices, wherein the attachment adapter comprises a channel formed between two parallel rims, and wherein the rims comprises one or more bores extending therethrough.

6. The scope mount assembly of claim 5, wherein the at least one scope mount rail assembly comprise a top rail assembly extending from a top portion of the front ring.

7. The scope mount assembly of claim 5, wherein the at least one scope mount rail assembly comprise a removable first side rail assembly extending from a first side of the front ring.

8. The scope mount assembly of claim 5, wherein the at least one scope mount rail assembly comprise a removable second side rail assembly extending from a second side of the front ring.

9. The scope mount assembly of claim 5, wherein the front ring comprises a top half and a bottom half, wherein the top half and the bottom half of the front ring are configured to be fastened together.

10. The scope mount assembly of claim 5, further comprising a rear ring extending from the rear portion of the base member, wherein the rear ring is configured to secure at least a portion of the scope therein.

11. The scope mount assembly of claim 10, wherein the rear ring comprises a top half and a bottom half, wherein the top half and the bottom half of the rear ring are configured to be coupled together.

12. The scope mount assembly of claim 5, wherein the base member comprises an attachment mechanism configured to removeably attach the base member to the rail assembly of the firearm.

13. The scope mount assembly of claim 5, wherein the channel comprises one or more crushable steps.

* * * * *